US006095514A

United States Patent [19]

Kudo et al.

[11] Patent Number: 6,095,514

[45] Date of Patent: Aug. 1, 2000

[54] SHEET SUPPLYING APPARATUS AND RECORDING OR READING APPARATUS

[75] Inventors: Tomohiro Kudo, Utsunomiya; Hajime Nakajima, Tokyo, both of Japan

[73] Assignee: Canon Kabushiki Kaisha, Tokyo, Japan

[21] Appl. No.: 09/031,796

[22] Filed: Feb. 27, 1998

[30] Foreign Application Priority Data

Feb. 28, 1997 [JP] Japan ..... 9-062498

[51] Int. Cl.[7] ..... B65H 3/34; B65H 3/08; B65H 1/08

[52] U.S. Cl. ..... 271/104; 271/107; 271/127

[58] Field of Search ..... 271/103, 104, 271/107, 108, 126, 127

[56] References Cited

U.S. PATENT DOCUMENTS

| | | | |
|---|---|---|---|
| 4,480,026 | 10/1984 | Kaneko | 271/103 |
| 4,506,876 | 3/1985 | Nishibori | 271/104 |
| 5,075,939 | 12/1991 | Michitoshi et al. | 271/104 |
| 5,100,121 | 3/1992 | Takei et al. | 271/104 |
| 5,227,004 | 7/1993 | Belger | 156/552 X |
| 5,257,776 | 11/1993 | Suya et al. | 271/11 X |
| 5,290,023 | 3/1994 | Sasaki et al. | 271/20 X |
| 5,553,841 | 9/1996 | Greive | 271/104 |

FOREIGN PATENT DOCUMENTS 7-81787 3/1995 Japan .

*Primary Examiner*—Christopher P. Ellis
*Assistant Examiner*—Kenneth W Bower
*Attorney, Agent, or Firm*—Fitzpatrick, Cella Harper & Scinto

[57] ABSTRACT

A a sheet supplying apparatus includes a sheet holding member adapted to hold a plurality of sheets and having a regulating wall for regulating movement of the sheets in a sheet supplying direction, a sucker member for absorbing with a vacuum force an uppermost sheet among the sheets held by the sheet holding member, and a pressure reducer for reducing pressure in the sucker. In addition, a driver drives the sucker member to convey the sheet absorbed by the vacuum, a height detector detects a height position of the uppermost sheet, and a sheet urging member urges the sheets in a sheet stacking direction and moves the sheet toward the regulating wall. The sheet member urges means urging the uppermost sheet with predetermined pressure on the basis of the detected height position.

16 Claims, 25 Drawing Sheets

SHEET SUPPLYING APPARATUS AND RECORDING OR READING APPARATUS

BACKGROUND OF THE INVENTION

1. Field of the Invention

The present invention relates to a sheet supplying apparatus for supplying a sheet to an image recording apparatus or an image reading apparatus, and a recording or a reading apparatus for recording or reading information on the sheet supplied by using such a sheet supplying apparatus.

2. Related Background Art

In conventional recording/reading apparatuses, a sheet is supplied to the apparatus by means of a sheet supplying apparatus, and an example of such a sheet supplying apparatus is disclosed in Japanese Patent Application Laid-open No. 7-81787. In this sheet supplying apparatus, for example, as shown in FIG. 27, a plurality of films F are stacked on a holding plate 1*a* of a sheet holding member 1, and regulating walls 1*b*, 1*c* for regulating movement of the films are provided along a film supplying direction and a film width-wise direction, respectively. The holding plate 1*a* is inclined so that an end at which the regulating plate 1*c* is disposed becomes lower than the other end. With this arrangement, ends (in the film supplying direction) of the films F and lateral edges (in the width-wise direction) of the films F abut against the regulating plates 1*b*, 1*c*, respectively, so that the ends (in the film supplying direction) of the films F are positioned in parallel with a main scanning direction of the recording/reading apparatus.

When the film F is supplied from the sheet holding member 1 to the recording/reading apparatus, a second drive source 3 is operated while maintaining a first drive source 2 in an inoperative condition. Consequently, a screw portion 4*a* is rotated together with a rotary shaft 4, with the result that a slider 6 is shifted to the left together with a nut 5. When the slider 6 is shifted, a pin 7 is shifted to the left in a pin guide slot 8*a* of an arm supporting member 8 to rotate arms 9, 10 around a support shaft 11, thereby shifting a sucker holding member 12 downwardly. Suckers 15, 16 supported by the sucker holding member 12 via nipples 13, 14 are contacted with a surface of the film F, and the film F is absorbed by the suckers 15, 16 by operating a vacuum pump (not shown).

In this condition, when both the first and second drive sources 2, 3 are operated, the rotary shaft 4 and the arm supporting member 8 are rotated in the same direction, with the result that the uppermost film F is supplied to the recording/reading apparatus. In this case, in dependence upon environmental conditions such as humidity and static electricity, not only the uppermost film F but also second and other films may be simultaneously lifted by the suckers 15, 16. To cope with this, corners of the lifted films F are flexed by a separation pawl 1*d* disposed above a corner of the sheet holding plate 1*a*, thereby separating the second and other films from the uppermost film F.

In recent years, in order to improve the ability of the recording/reading apparatus, it has been requested that the film F is supplied so that a tip end of the film F is not inclined with respect to the main scanning direction and that the film F is conveyed in a sub-scanning direction with an optimum posture. However, in the above-mentioned example, when the uppermost film F and the second and other films F are flexed by the separation pawl 1*d*, postures of the uppermost film F and the second and other films F are deviated from their original optimum postures and, when the second and other films F are dropped, the postures of the second and other films F are deviated from their original optimum postures, with the result that the film F is supplied with an incorrect posture.

SUMMARY OF THE INVENTION

An object of the present invention is to provide a sheet supplying apparatus which can eliminate the above-mentioned conventional drawback and can supply a sheet with a correct posture.

Another object of the present invention is to provide a recording or reading apparatus in which recording or reading is effected regarding a sheet having a correct posture by using a sheet supplying apparatus.

DETAILED DESCRIPTION OF THE PREFERRED EMBODIMENTS

The present invention will now be explained in connection with embodiments thereof with reference to FIGS. 1 to 26.

Figure 1:
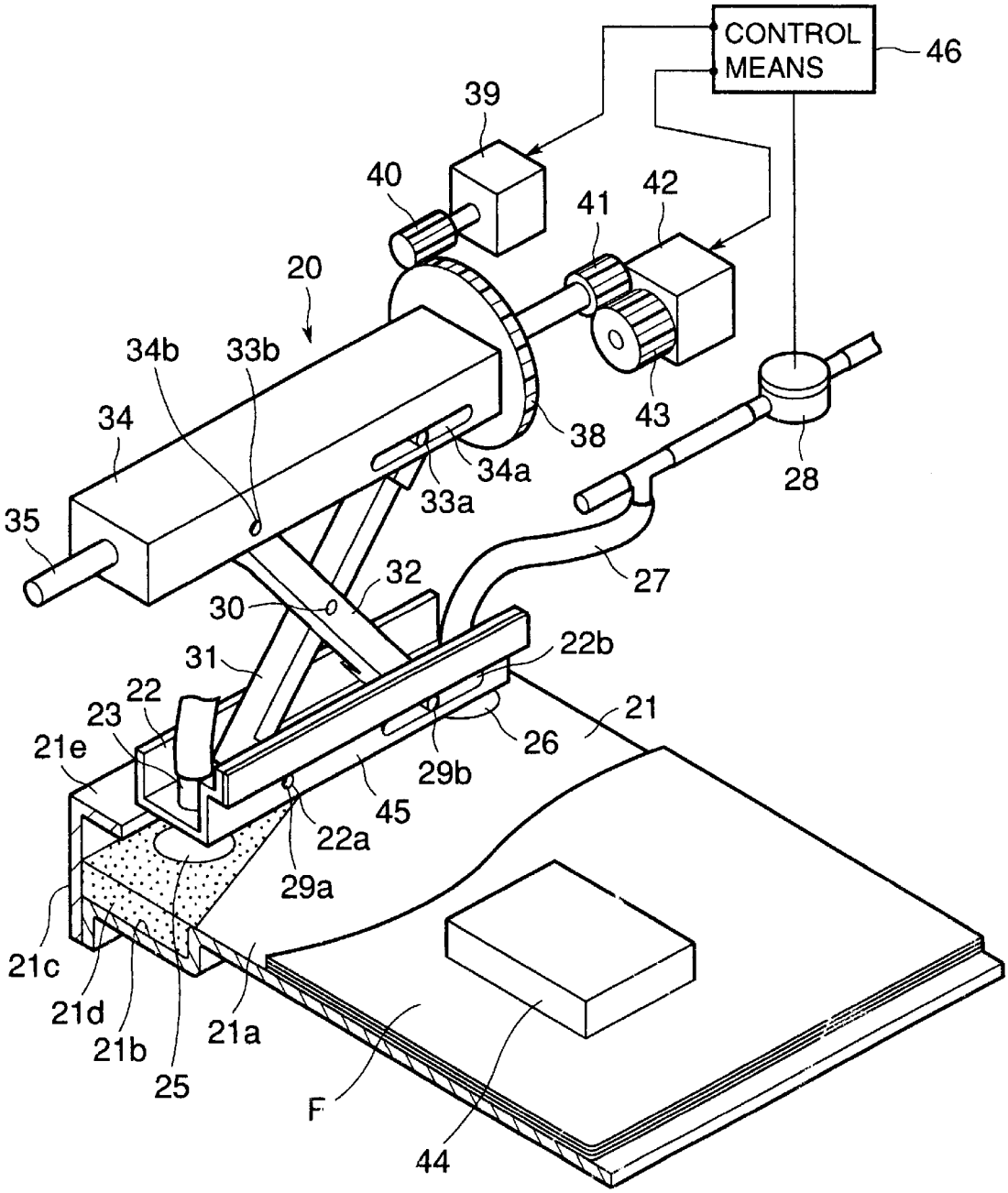
FIG. 1 is a perspective view of a sheet supplying apparatus according to a first embodiment of the present invention.
Figure 2:
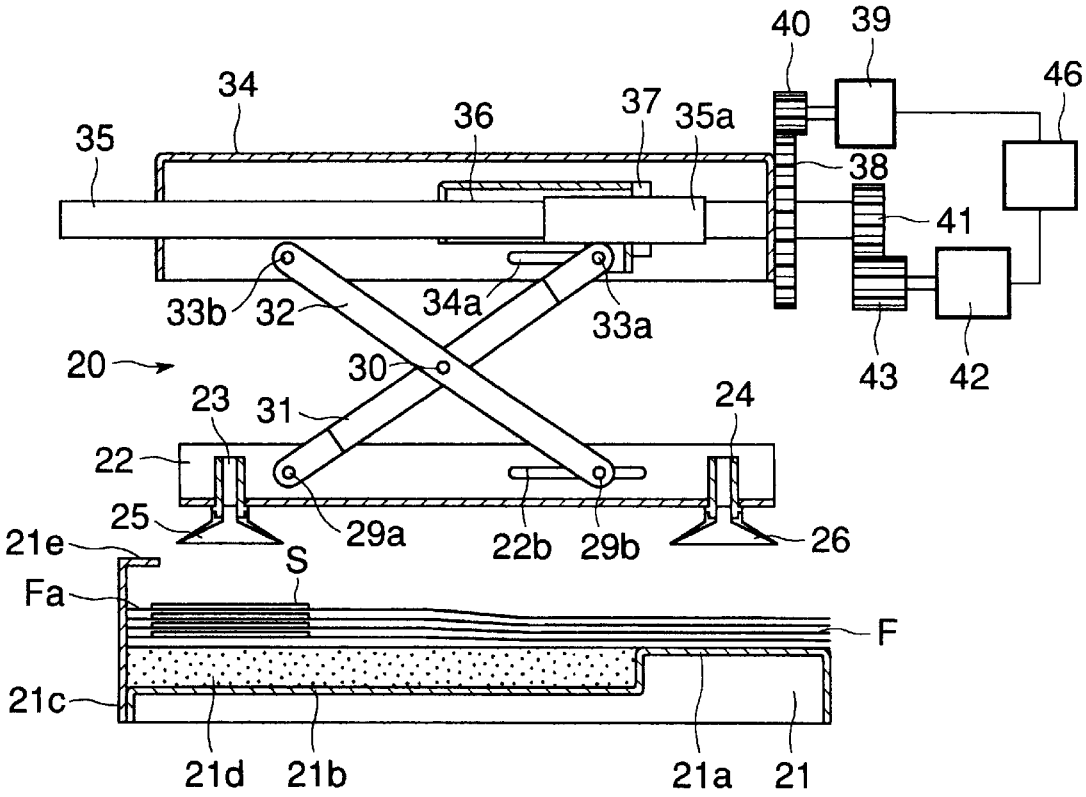
FIG. 2 is an elevational sectional view of the sheet supplying apparatus.
Figure 3:
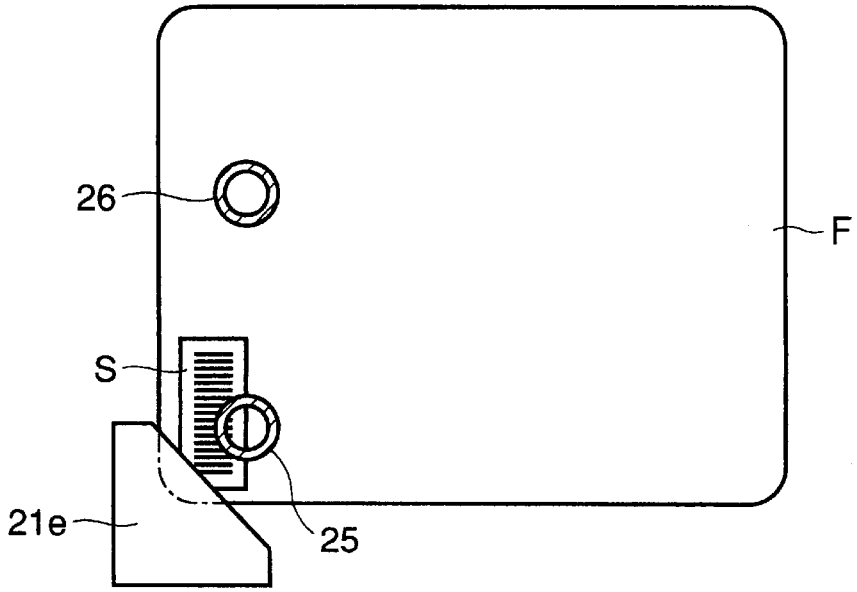
FIG. 3 is a partial horizontal sectional view of the sheet supplying apparatus.
Figure 4:
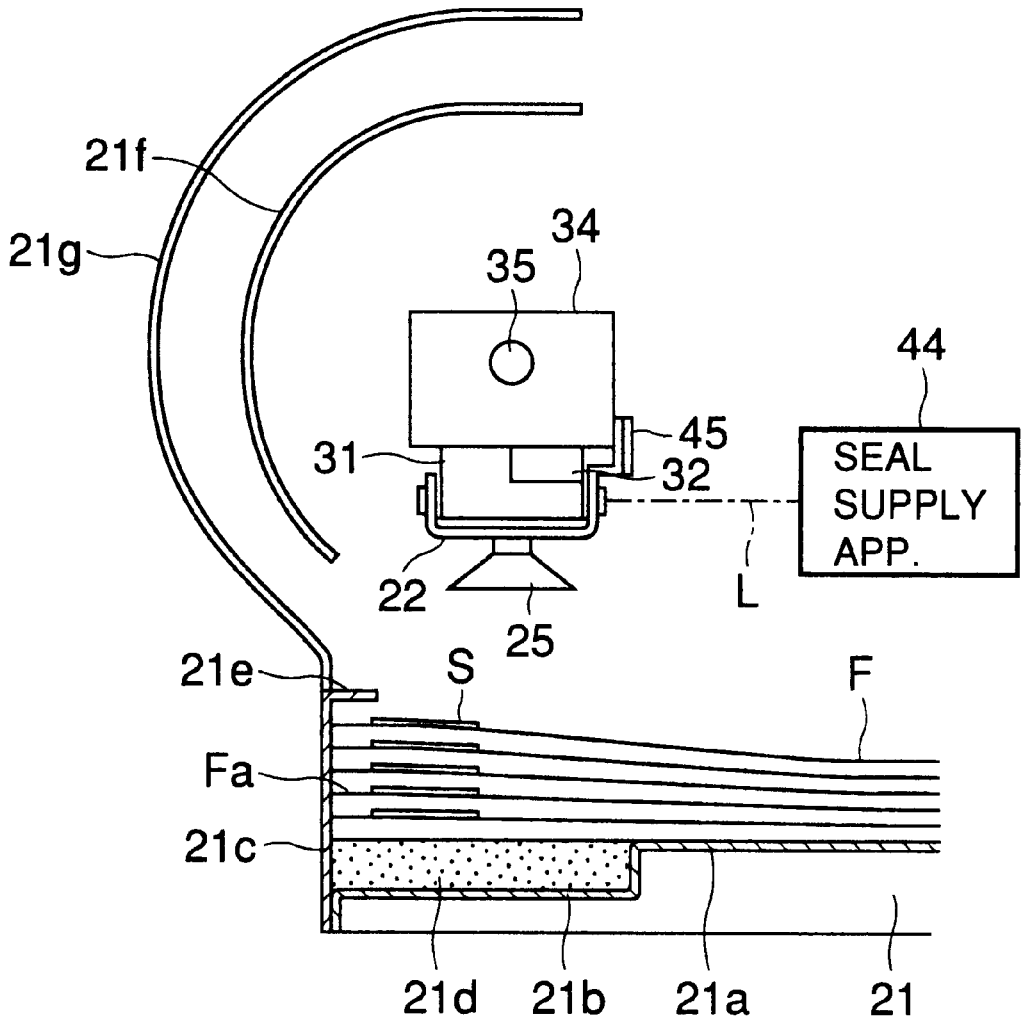
FIG. 4 is a partial side view of the sheet supplying apparatus.

FIG. 1 is a perspective view of a sheet supplying apparatus 20 according to a first embodiment of the present invention, FIG. 2 is an elevational sectional view of the sheet supplying apparatus, FIG. 3 is a partial horizontal sectional view of the sheet supplying apparatus, and FIG. 4 is a partial side view of the sheet supplying apparatus. A plurality of films F having, for example, medical information thereon are stacked on an upper surface of a sheet holding member 21 like a table. A seal S having bar code is adhered to a corner of each film F. Thus, a swollen portion Fa is formed in the film stack F due to the presence of the seals S.

The sheet holding member 21 is provided with an upper portion 21*a* for supporting a major part of the film stack F and a lower portion 21*b* disposed lower than the upper portion 21*a* in the vicinity of the swollen portion Fa. The plane configuration of the lower portion 21*b* is a triangle an area of which is gradually increased toward the swollen portion Fa, and a regulating plate 21*c* for regulating movement of the films F is attached to an end (in a film supplying direction) of the lower portion 21*b* so that the regulating plate extends in parallel with a main scanning direction of an image reading apparatus (not shown).

An elastic member 21*d* made of sponge or rubber is disposed on the lower portion 21*b* of the sheet holding member 21, and a thickness of the elastic member 21*d* is selected so that an upper surface of the elastic member becomes substantially flush with an upper surface of the upper portion 21*a*. A pawl portion 21*e* is disposed above a corner of the swollen portion Fa of the film stack F so that corners of a plurality of films F lifted upwardly are temporarily flexed by the pawl portion 21*e* to positively separate second and other films F from an uppermost film F. Arcuate guides 21*f*, 21*g* for guiding the film F toward the image reading apparatus are disposed above the pawl portion 21*e*.

A sucker holding member 22 having U-shaped cross-section is disposed above the sheet holding member 21 so constructed, and nipples 23, 24 are press-fitted into holes formed in a bottom of the sucker holding member 22. Suckers 25, 26 are mounted on lower ends of the nipples 23, 24, and upper ends of the nipples 23, 24 are connected to a vacuum pump (not shown) through flexible tubes 27. A pressure sensor 28 is provided in association with the flexible tubes 27 so that pressure change caused when the films F are absorbed by the suckers 25, 26 is detected by the pressure sensor 28 to generate an absorption detection signal.

Opposed pin holding holes 22*a* and opposed pin guiding slots 22*b* are formed in both side walls of the sucker holding member 22, and a pin 29*a* is rotatably received in the pin holding holes 22*a* and a pin 29*b* is rotatably and slidably received in the pin guiding slots 22*b*. The sucker holding member 22 is supported by arms 31, 32 which are crossed with each other and pivotally mounted on a pin 30. Lower ends of the arms 31, 32 are connected to the pins 29*a*, 29*b*, respectively, and upper ends of the arms 31, 32 are supported by an arm supporting member 34 via pins 33*a*, 33*b*, respectively.

Similar to the sucker holding member 22, regarding the arm supporting member 34, the pin 33*a* is rotatably and slidably received in opposed pin guiding slots 34*a* formed in both side walls of the arm supporting member 34 and the pin 33*b* is rotatably received in opposed pin holding holes 34*b* formed in both side walls of the arm supporting member 34. With this arrangement, the sucker holding member 22 is supported in parallel with the arm supporting member 34 and can be shifted with respect to the arm supporting member 34 in an up-and-down direction. In this case, at an initial position of the sucker holding member 22 for rotation and vertical shifting movement, it is preferable that the arms 31, 32 are contained within the arm supporting member 34 in a folded condition and the suckers 25, 26 are arranged substantially in parallel with the film F.

The arm supporting member 34 is secured to a rotary shaft 35 which extends through the arm supporting member 34 and which is rotatably supported by a frame (not shown). A slider 36 is mounted on the rotary shaft for axial movement and a nut 37 is secured to one end of the slider 36. The nut 37 is threaded onto a threaded portion 35*a* formed on the rotary shaft 35 and a lower portion of the slider 36 is connected to the pin 33*a*. Further, a gear 38 is secured to one end of the arm supporting member 34, which gear 38 is meshed with a gear 40 of a first drive source 39. A gear 41 is secured to an end of the rotary shaft 35, which gear 41 is meshed with a gear 43 of a second drive source 42.

A seal reading means 44 for reading the bar code on the seal S is disposed above the sheet holding member 21, and a reflection mirror 45 for deflecting scanning light L emitted from the seal reading means 44 is attached to the sucker holding member 22. The vacuum pump, pressure sensor 28, first and second drive sources 39, 42 and seal reading means 44 are connected to a control means 46.

Figure 5:
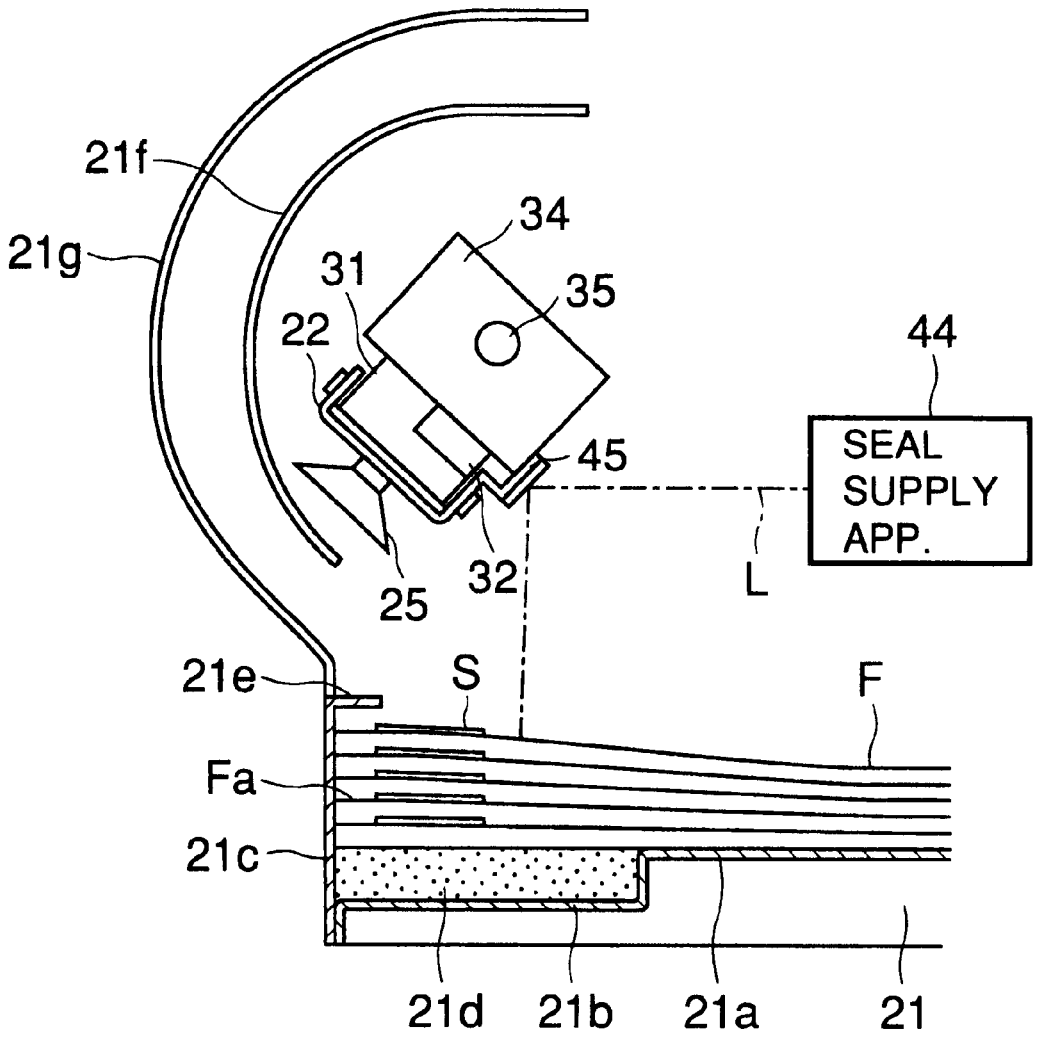
FIGS. 5, 6, 7, 8, 9, 10, 11, 12, 13, 14, 15 and 16 are views for explaining an operation of the sheet supplying apparatus.

In the sheet supplying apparatus 20 so constructed, when the bar code of the seal adhered to the film F is read by the seal reading means, in the condition that the sucker holding member 22 is in the initial position, both the first and second drive sources 39, 42 are operated on the basis of a signal from the control means 46. As a result, as shown in FIG. 5, the rotary shaft 35 and the arm supporting member 34 are rotated in the same direction at the same angular speed, so that the sucker holding member 22 is rotated in such a condition that a distance between the sucker holding member 22 and the rotary shaft 35 is kept constant.

Figure 6:
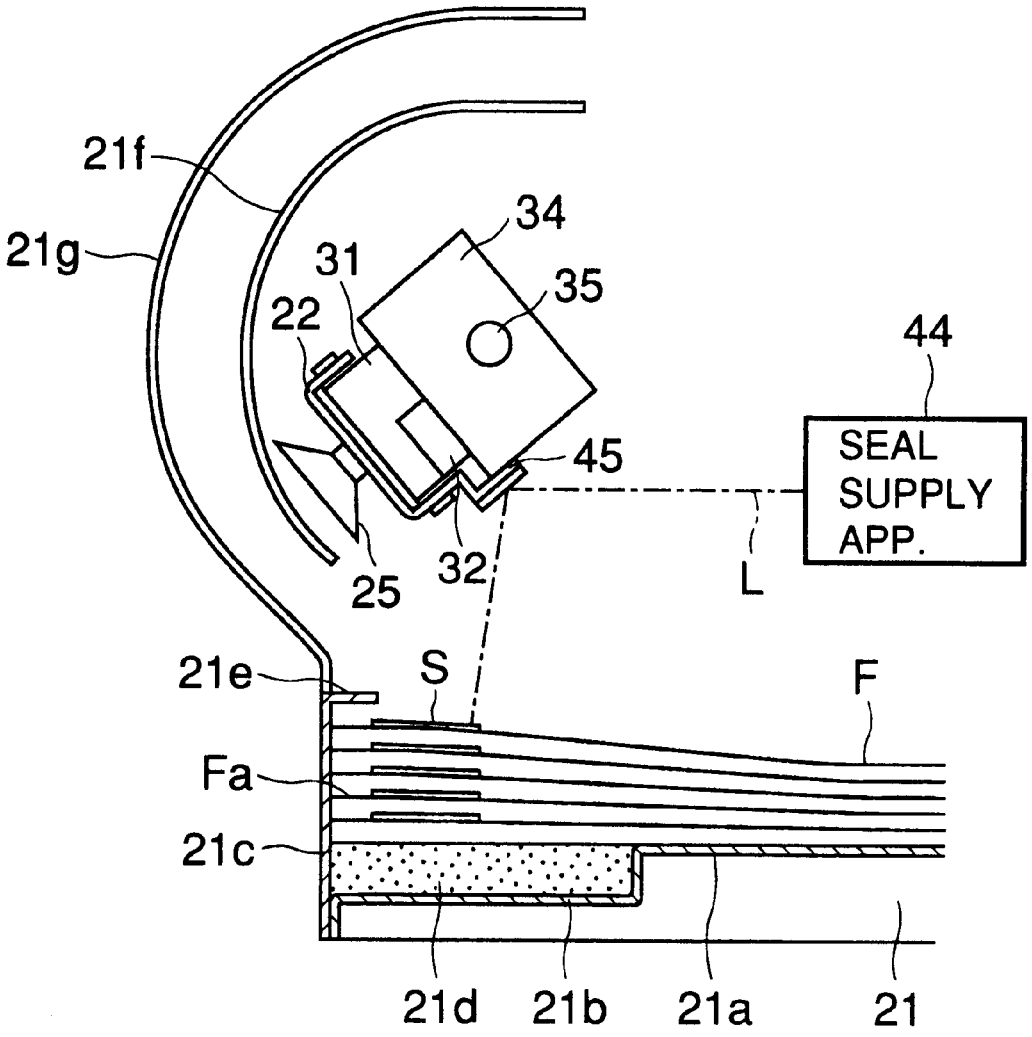
Figure 7:
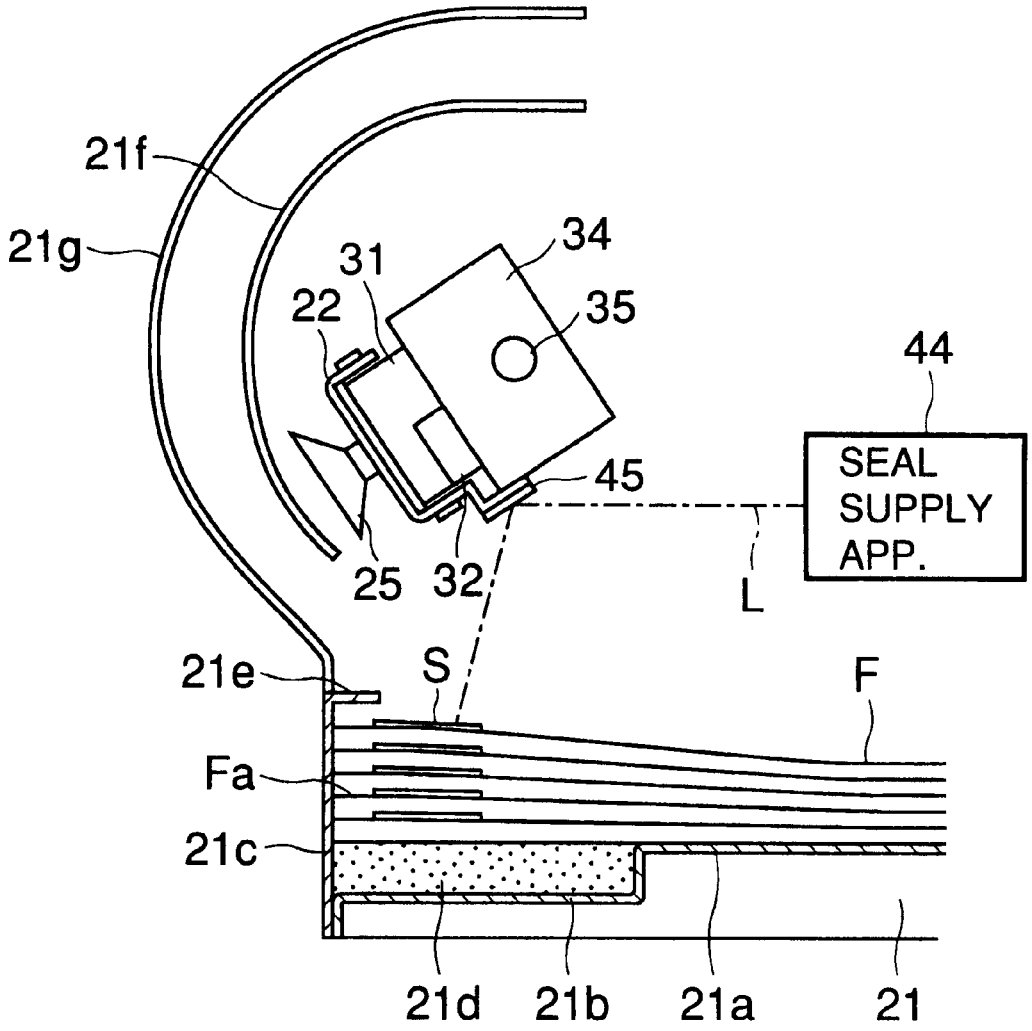

When the sucker holding member 22 is rotated, as shown in FIG. 6, the scanning light L emitted from the seal reading means 44 and reflected by the reflection mirror 45 starts to be incident on the seal S at a certain angle. When the sucker holding member 22 is further rotated, as shown in FIG. 7, the scanning light L scans the entire bar code on the seal S. After the scanning operation is finished, the sucker holding member 22 is returned to the initial position shown in FIG. 4, and information of the bar code is transferred to a system control portion (not shown) and this information is added to data read from image information during subsequent film supplying and scanning operations.

When a posture of the uppermost film F is corrected, the second drive source 42 is operated while maintaining the first drive source 39 in an inoperative condition, with the result that the threaded portion 35*a* of the rotary shaft 35 is rotated, thereby shifting the nut 37 to the left together with the slider 36. Consequently, the pin 33*a* is slid to the left within the pin guiding slots 34*a*, with the result that the arms 31, 32 are rotated around the pin 30, thereby lowering the sucker holding member 22, keeping a condition horizontal.

Figure 8:
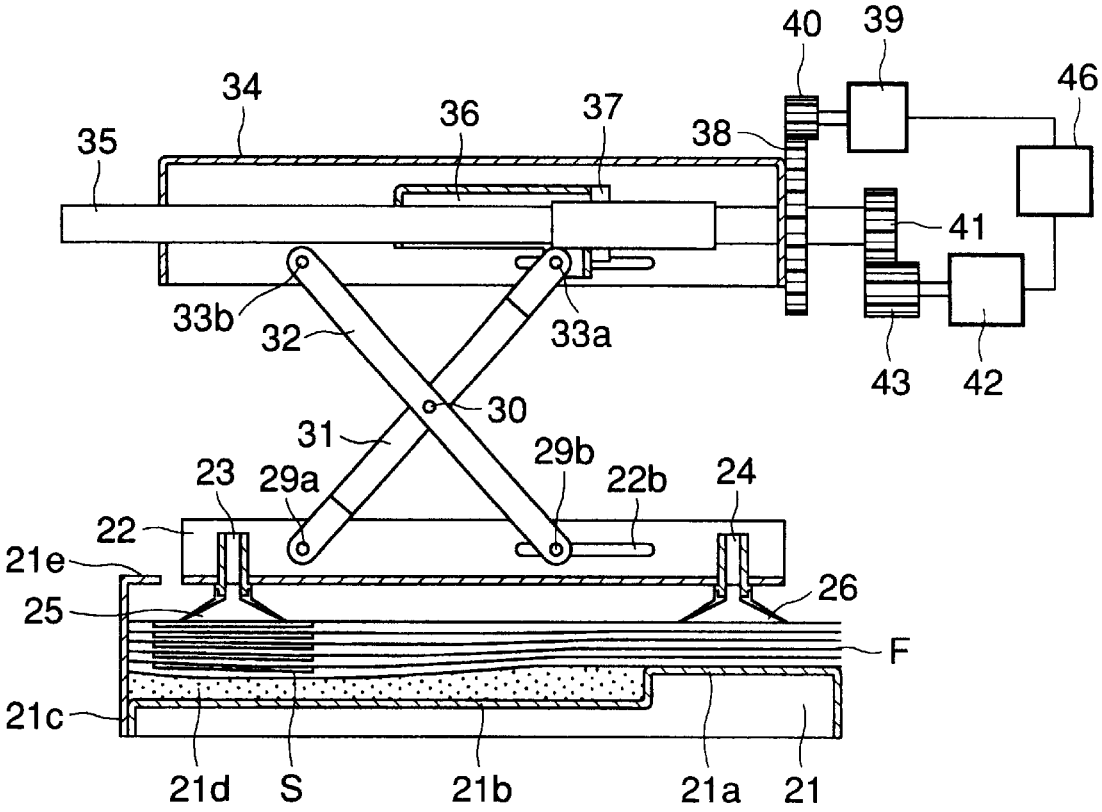
Figure 9:
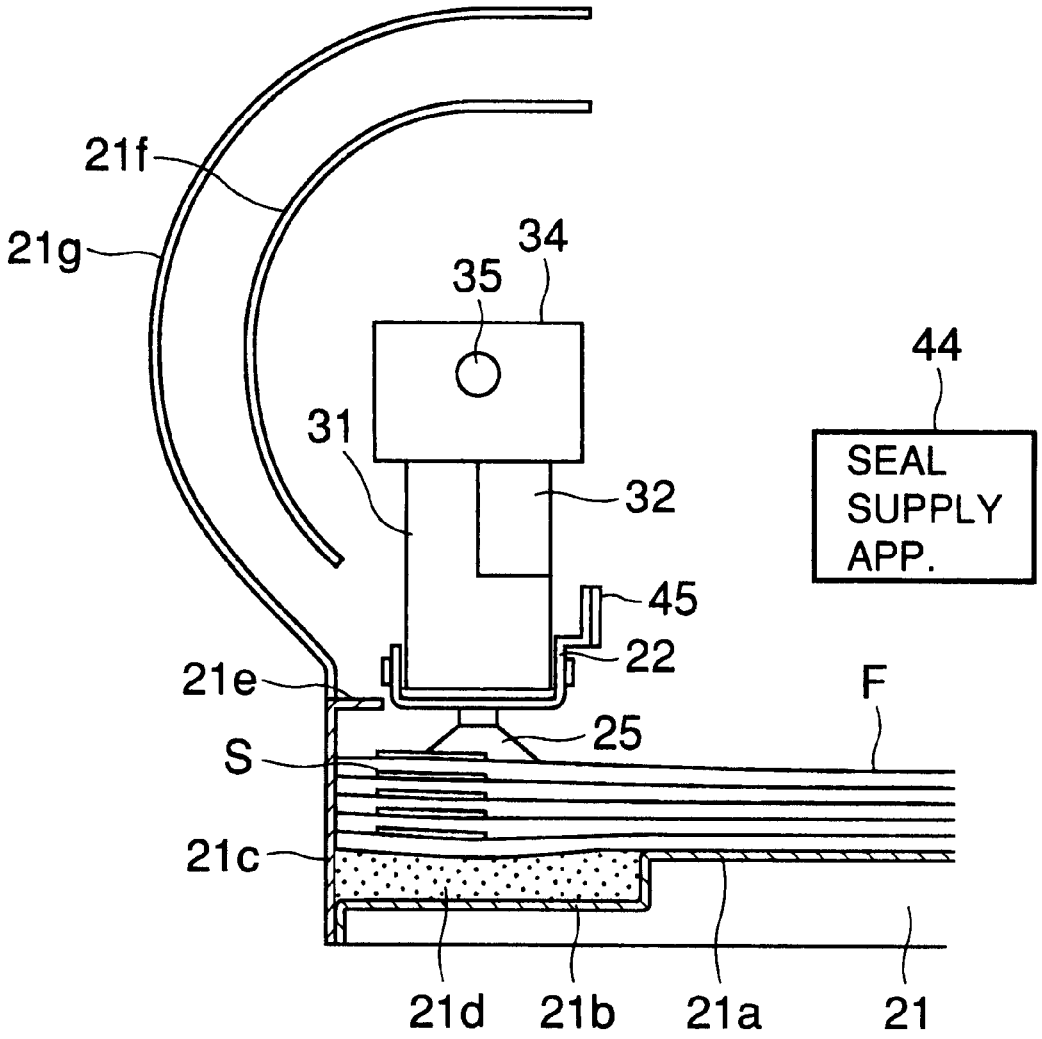

In this case, the vacuum pump starts to be operated and a shift amount of the sucker holding member starts to be counted. As shown in FIGS. 8 and 9, when the suckers 25, 26 are contacted with the uppermost film F, the pressure change is detected by the pressure sensor 28 to generate the absorption detection signal. In response to this absorption detection signal, the lowering movement of the sucker holding member 22 is stopped and the operation of the vacuum pump is temporarily stopped.

In this case, since a distance through which the sucker holding member 22 is shifted from the initial position to the sheet holding member 21 is constant and a thickness of the film F is also constant, the counted value is converted into the shift amount of the sucker holding member 22 and a height position of the uppermost film F is calculated. When the sucker holding member 22 is rotated, the uppermost film F is moved by the suckers 25, 26 and, after the tip end of the uppermost film F abuts against the regulating plate 21*c*, the sucker holding member 22 is stopped at a position where the uppermost film F can be urged by the suckers 25, 26 by pressure shiftable on the upper surface of the film F.

Figure 10:
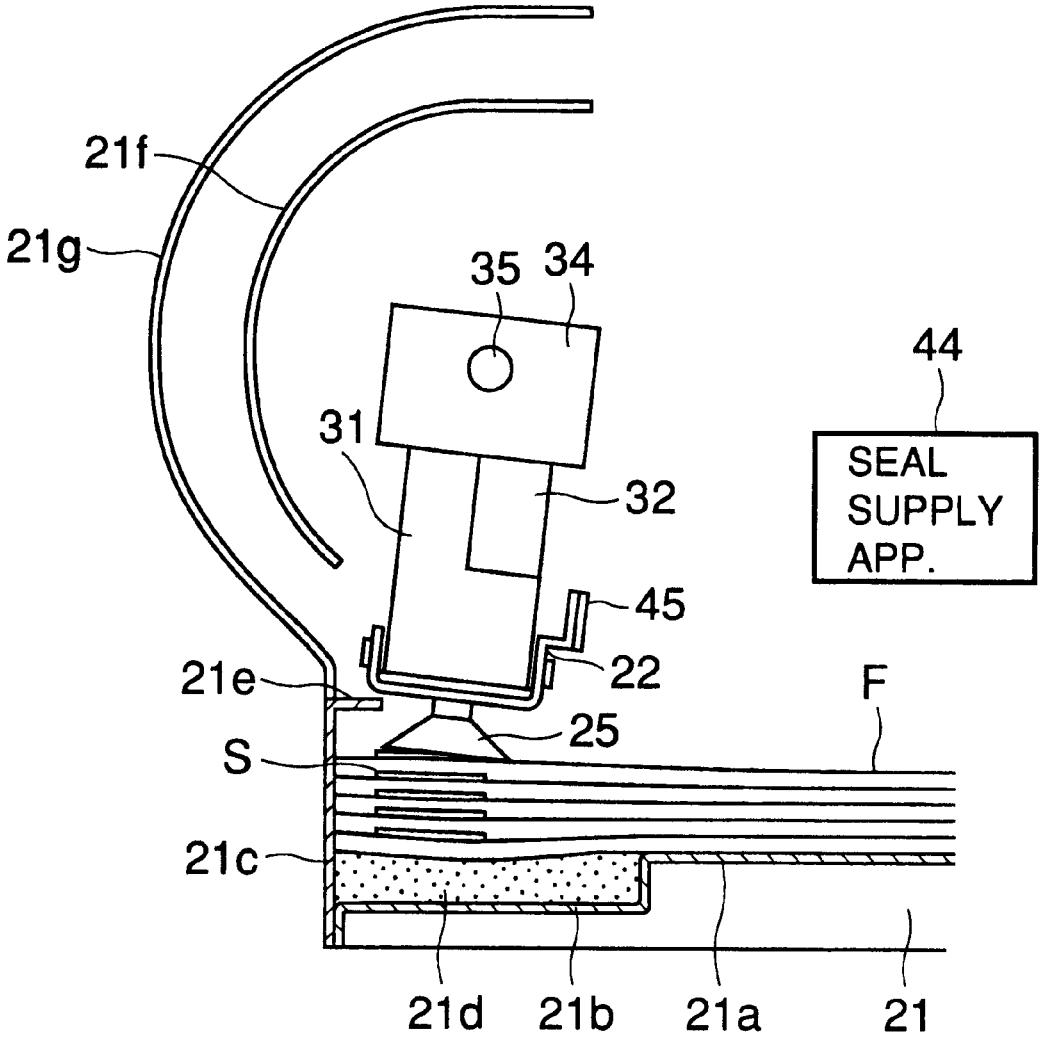

In this condition, both the first and second drive sources 39, 42 are operated. When the sucker holding member 22 is rotated around the rotary shaft 35, the sucker holding member 22 is rotated as shown in FIG. 10. As a result, the suckers 25, 26 move the uppermost film F to abut the tip end of the film against the regulating plate 21*c*, thereby maintaining the tip end (in the film supplying direction or sub-scanning direction) of the uppermost film F in parallel with the main scanning direction of the image reading apparatus. Thereafter, the suckers 25, 26 are slid on the upper surface of the film F.

Figure 11:
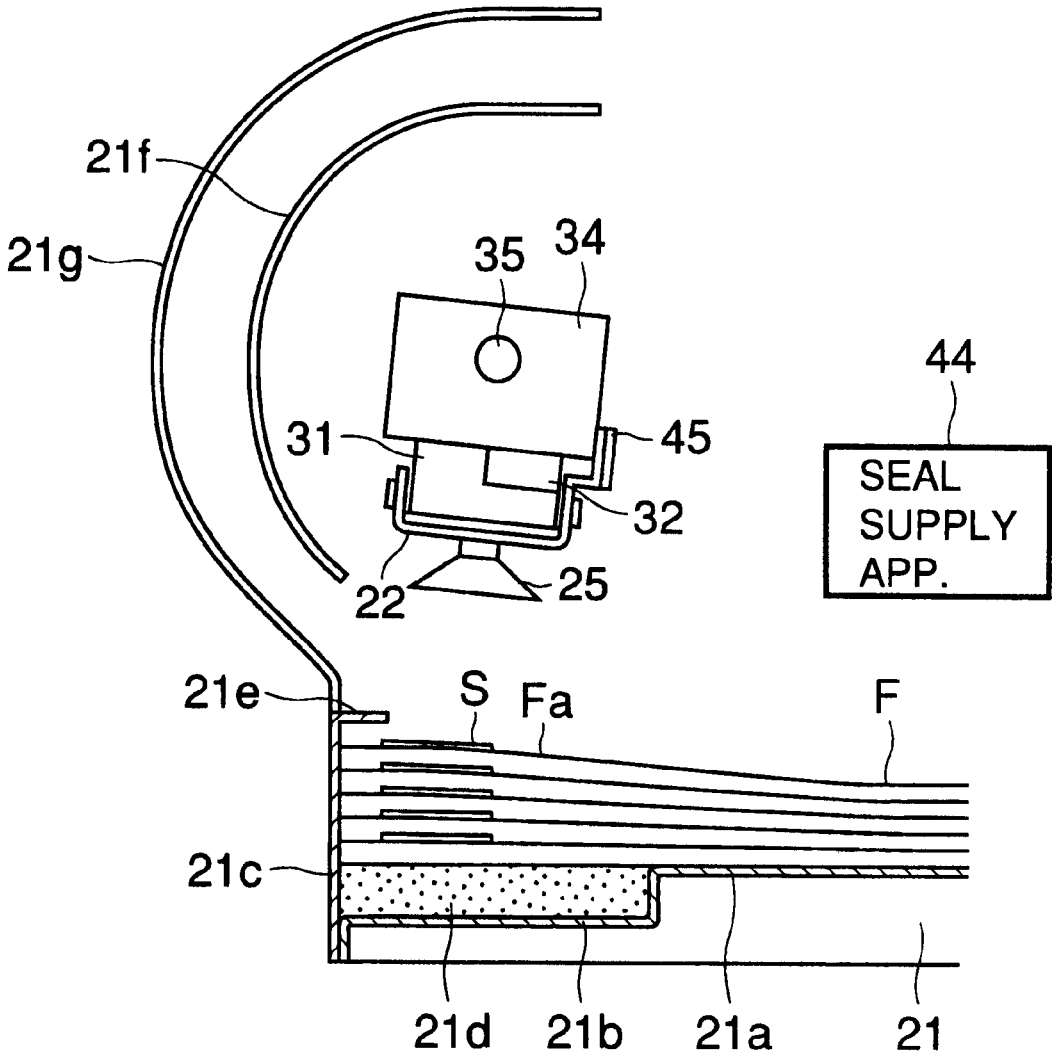
Figure 12:
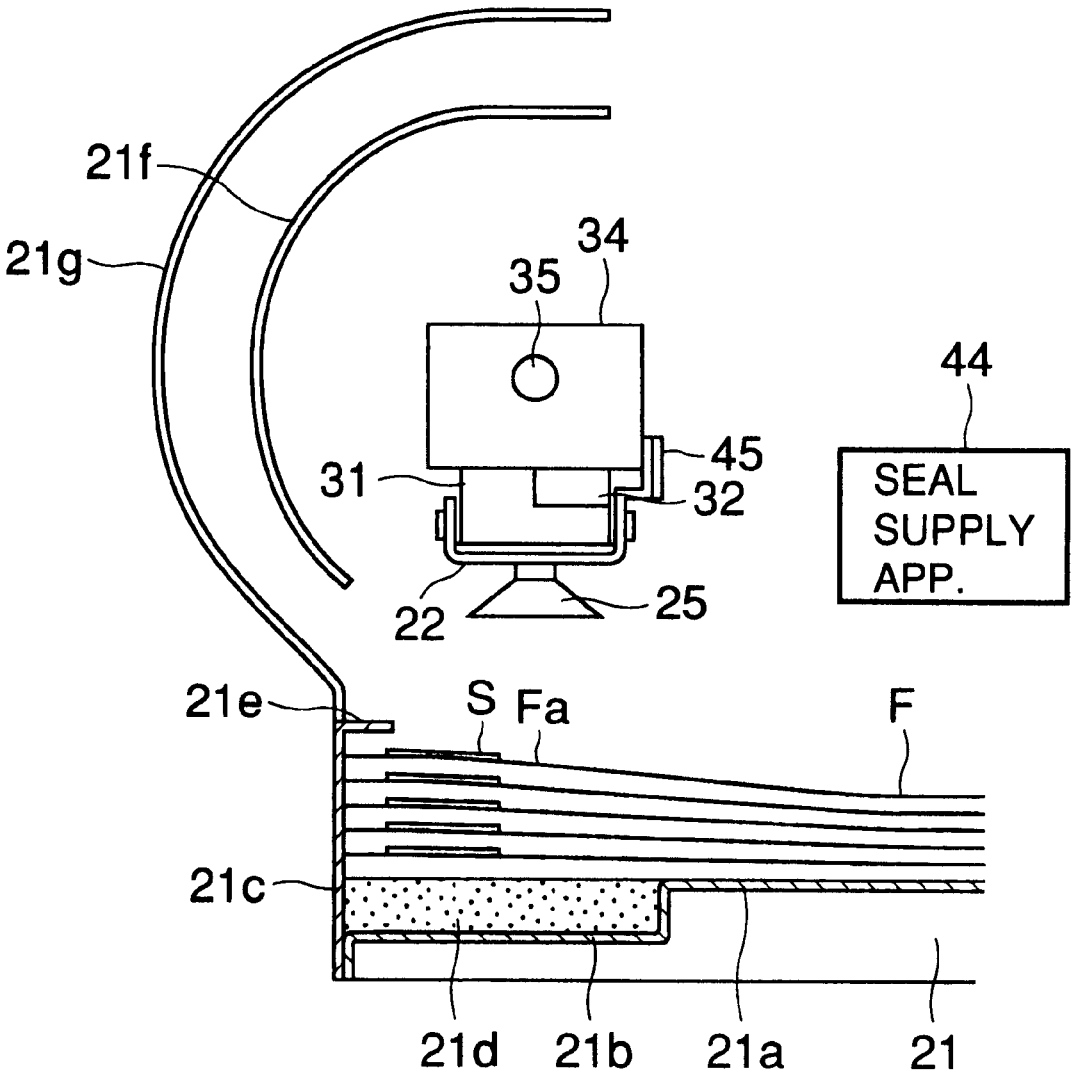

As the height position of the uppermost film F is decreased, the lowering shift amount of the sucker holding member 22 is increased. In this case, when the sucker holding member 22 is rotated, the suckers 25, 26 are apt to be struck against the regulating plate 21*c* to urge the film against the regulating plate 21*c* excessively, with the result that the suckers may be deviated due to a reaction force from the film. To avoid this, the rotational amount of the sucker holding member 22 is selected so that the suckers 25, 26 are not struck against the regulating plate 21*c* and the suckers are not deviated due to the reaction force. After the sucker holding member 22 is lifted as shown in FIG. 11, the sucker holding member is returned to the initial position as shown in FIG. 12.

Figure 13:
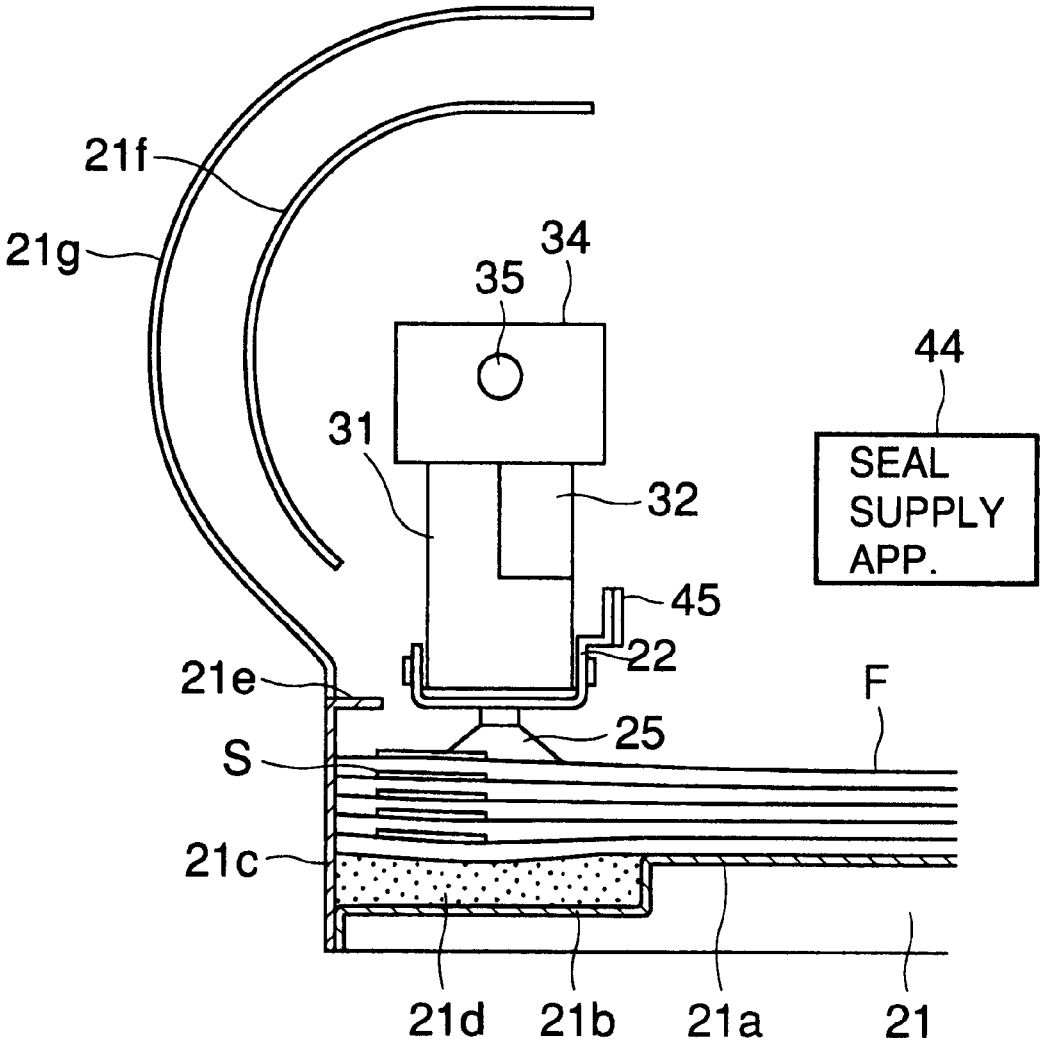

When the film F is supplied, as shown in FIG. 13, the sucker holding member 22 is lowered again and the vacuum pump is operated. When pressure reduction occurs in the suckers 25, 26, the swollen portion Fa of the film stack F is disappeared by the action of the elastic member 21*d*, with the result that the film F can be absorbed by the suckers 25, 26 effectively.

Figure 14:
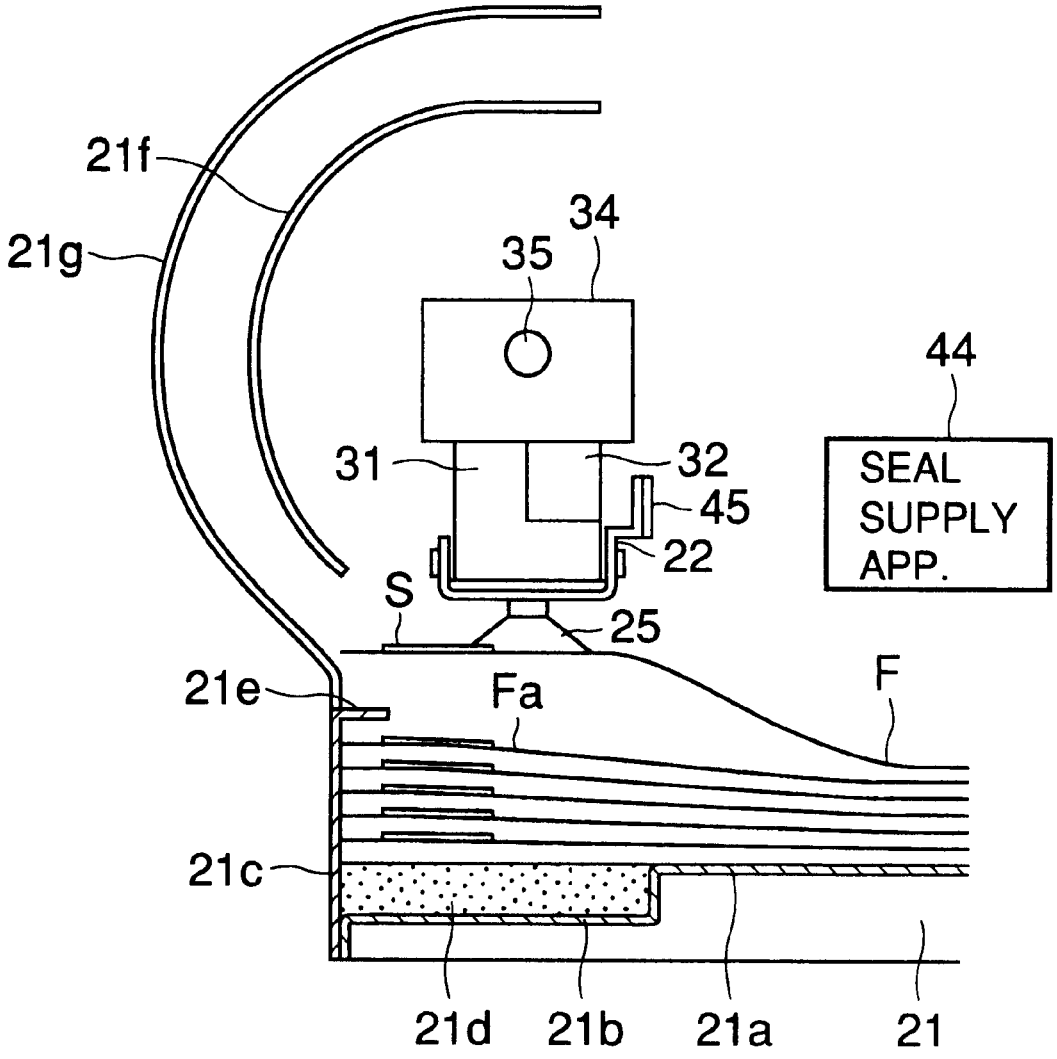

Then, by operating the second drive source 42 in the reverse direction, as shown in FIG. 14, when the sucker holding member 22 is lifted to a predetermined position, the corners of the lifted films F are flexed by the pawl portion 21*e*, thereby separating second other films from the uppermost film F.

Figure 15:
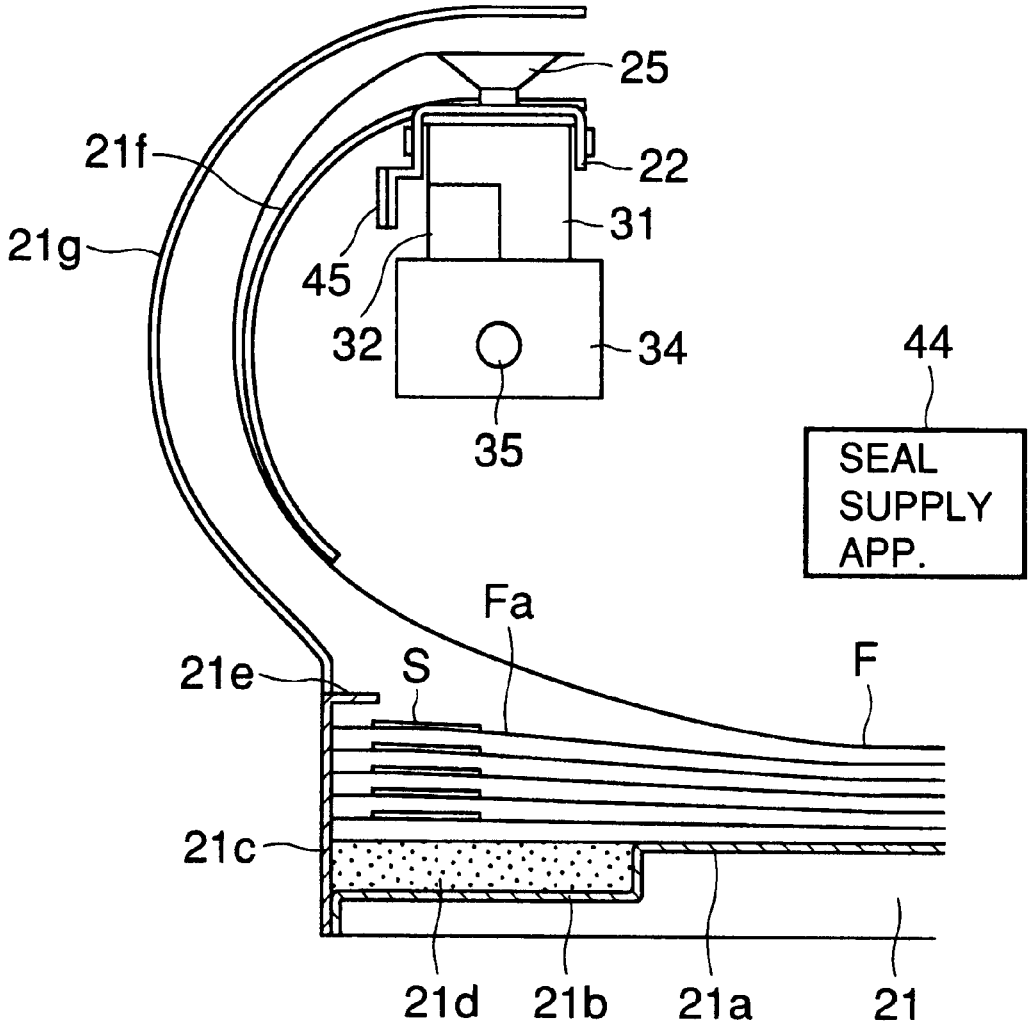
Figure 16:
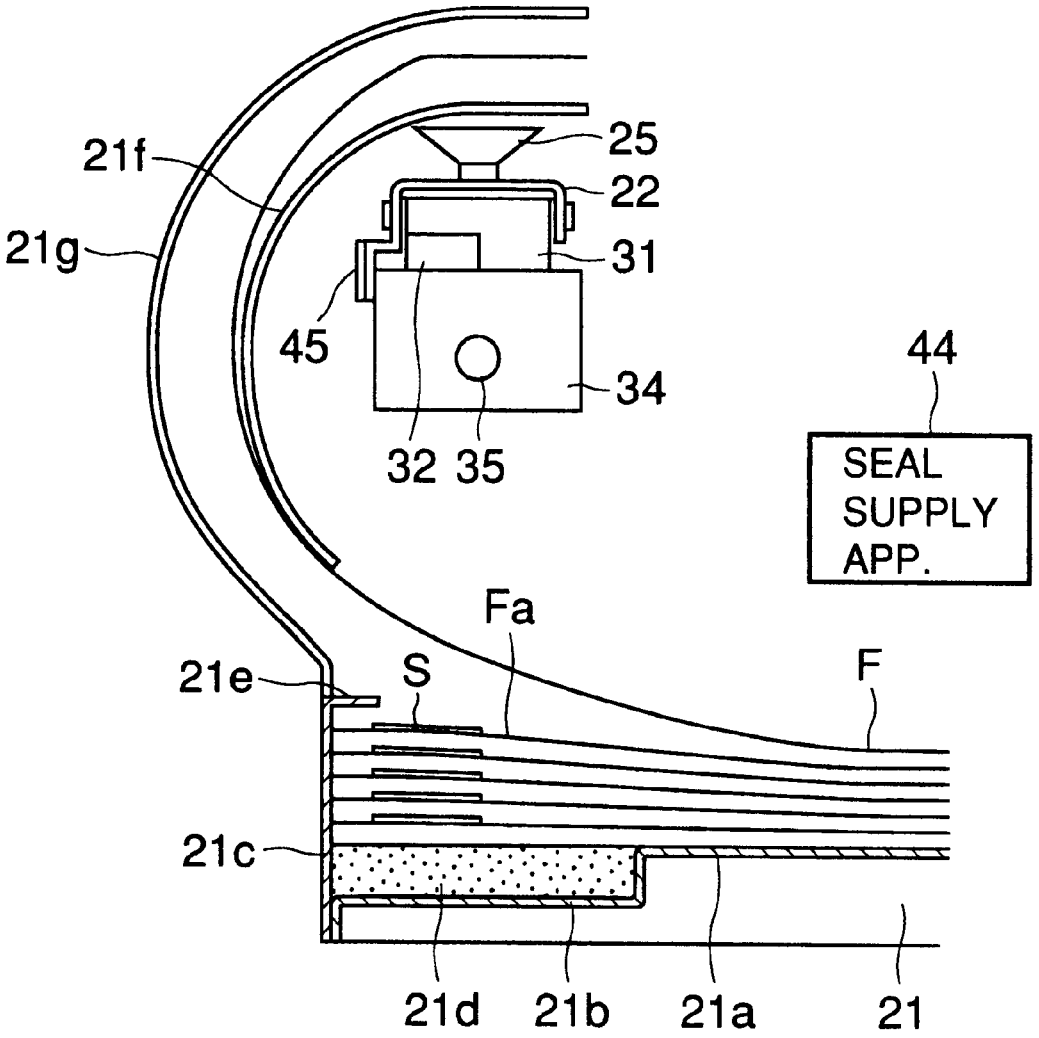

Thereafter, when the both first and second drive sources 39, 42 are operated, the rotary shaft 35 and the arm supporting member 34 are rotated in the same direction at the same angular speed, so that, as shown in FIG. 15, the film F is supplied to the image reading apparatus through between the guides 21*f* and 21*g* while keeping the distance between the sucker holding member 22 and the rotary shaft 35 constant. Thereafter, the operation of the vacuum pump is stopped, with the result that the film F is released from the suckers 25, 26 as shown in FIG. 16.

As mentioned above, in the first embodiment, since the vertical shift amount and the rotational amount of the sucker holding member 22 by detecting the height position of the uppermost film F and the film F is moved by the predetermined pressure until the film abuts against the regulating plate 21*c*, the film F can be supplied after it is corrected to the correct posture. In this case, after plural films F are supplied, the height position of the uppermost film F is decreased to increase the lowering shift amount of the sucker holding member 22, thereby increasing the distance between the sucker holding member 22 and the rotary shaft 35. However, in this case, since the rotational amount of the suckers 25, 26 is regulated on the basis of the height position of the uppermost film F, the posture of the film F can be prevented from becoming incorrect, the suckers 25, 26 can be prevented from being struck against the regulating plate 21*c* and the suckers can be prevented from being deviated due to the reaction force, thereby correcting the posture of the film F stably.

Figure 17:
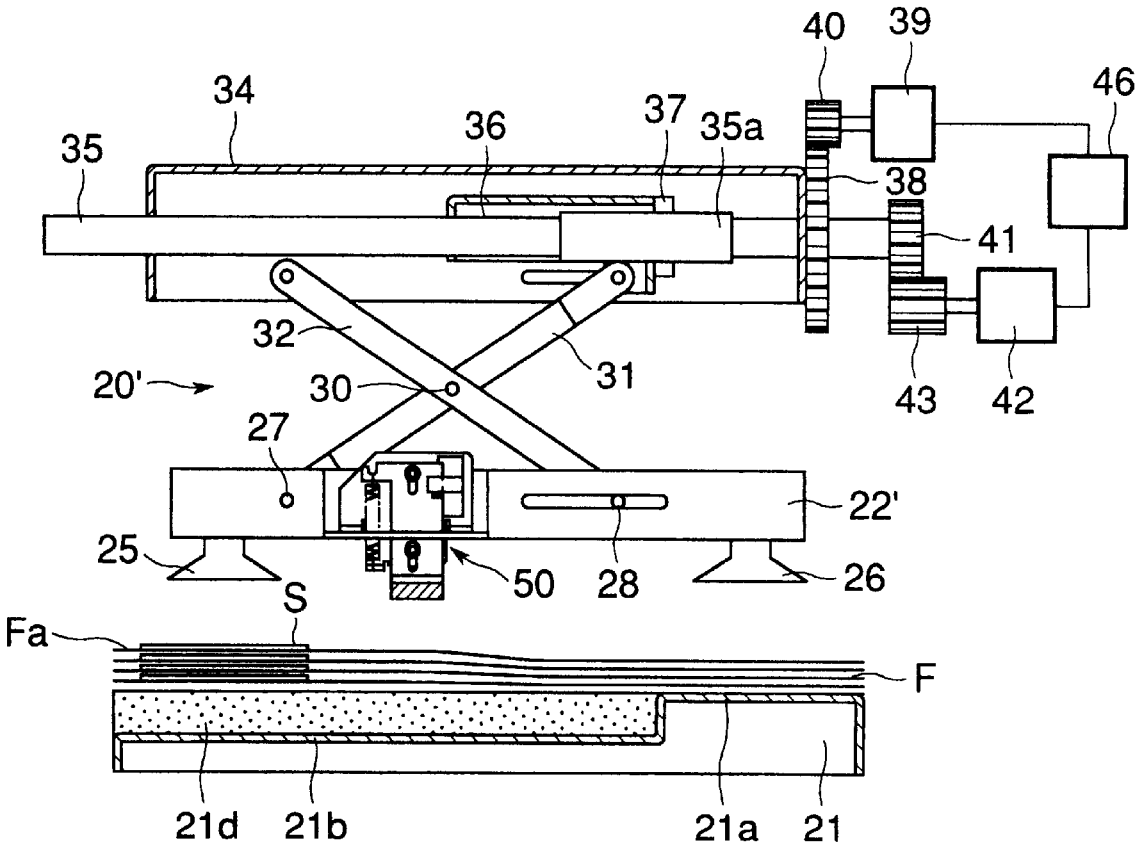
FIG. 17 is a perspective view of a sheet supplying apparatus according to a second embodiment of the present invention.
Figure 18:
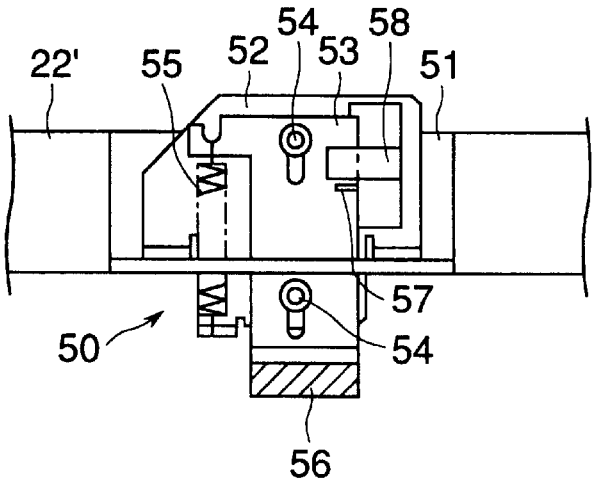
FIG. 18 is a partial enlarged view of the sheet supplying apparatus.
Figure 19:
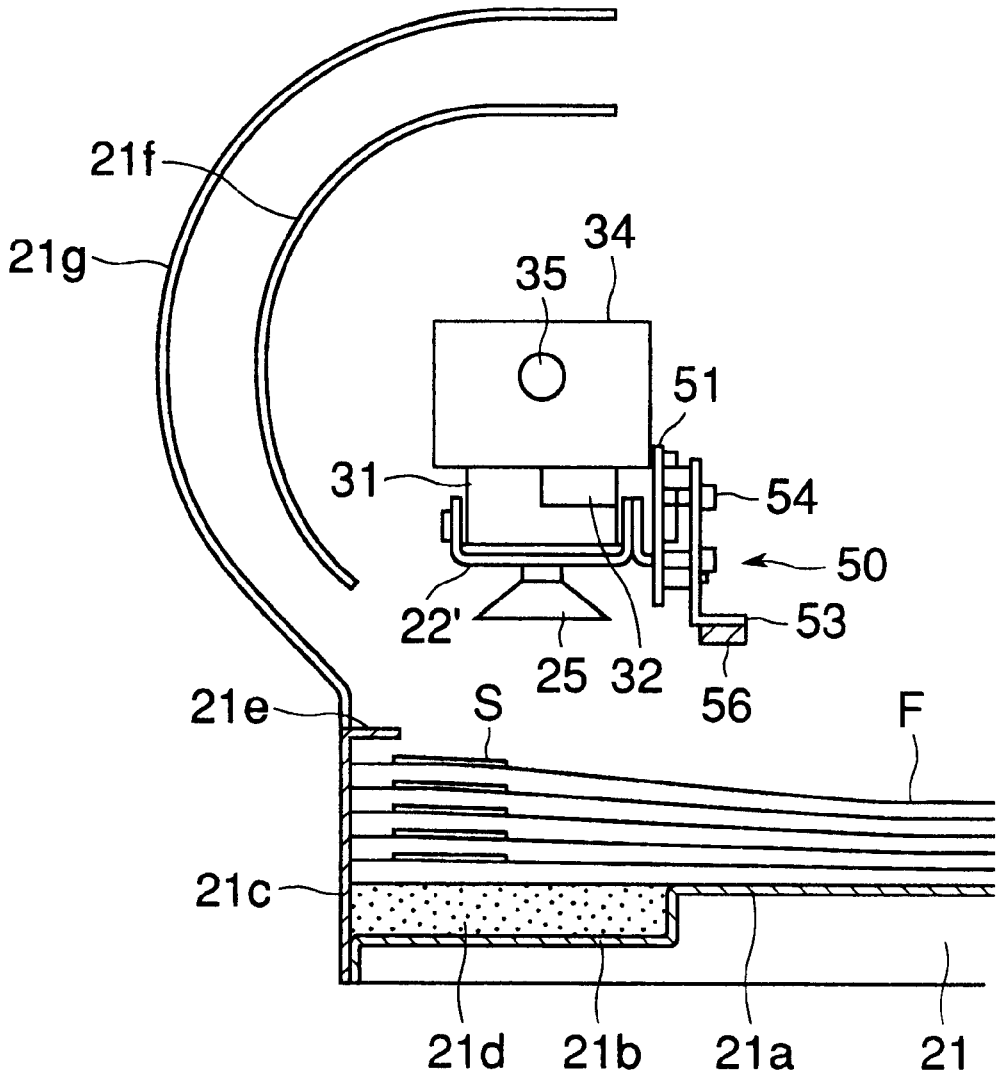
FIG. 19 is a partial side view of the sheet supplying apparatus.

FIG. 17 is an elevational view of a sheet supplying apparatus 20' according to a second embodiment of the present invention, FIG. 18 is a partial enlarged view of such a sheet supplying apparatus and FIG. 19 is a partial side view of such a sheet supplying apparatus. In this sheet supplying apparatus, a height detecting mechanism 50 for urging the uppermost film F and for detecting the height position of the uppermost film is attached to a sucker holding member 22'. More specifically, an attachment plate 51 to which the height detecting mechanism 50 is attached is attached to a side surface (upstream of the film supplying direction) of the sucker holding member 22' adjacent to the suckers 25, 26 and substantially in parallel with the suckers. A detecting lever substrate 52 is attached to the attachment plate 51, and a detecting lever 53 is attached to the detecting lever substrate 52 via a guide shaft 54 for sliding movement in the same direction as a vertical movement direction of the sucker holding member 22'. The detecting lever 53 is biased downwardly by a spring 55.

A rubber member 56 is secured to a lower end of the detecting lever 53 so that the rubber member 56 is contacted with the uppermost film F before the suckers 25, 26 are contacted with the uppermost film. A slit 57 is formed in one side surface of the detecting lever 53. The slit 57 is detected by a photo-detector 58 when the rubber member 56 secured to the lower end of the detecting lever 53 is contacted with the uppermost film F and moved upwardly by a reaction force. On the basis of a signal from the photo-detector 58, the height position of the uppermost film F is detected, with the result that the height detecting mechanism 50 urges the uppermost film F with predetermined pressure similar to the first embodiment and the sucker holding member 22' rotated as is in the first embodiment.

Figure 20:
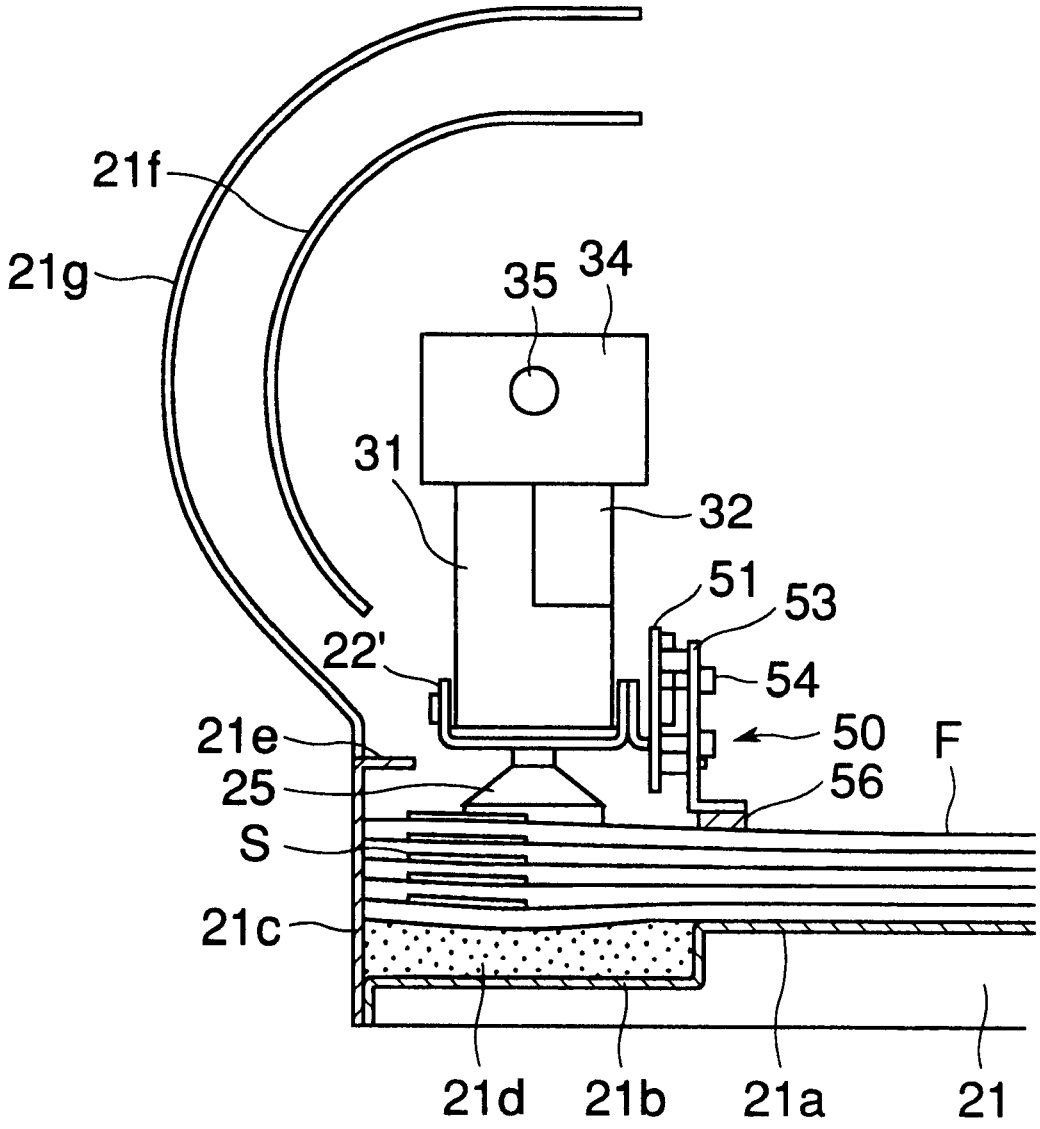
FIGS. 20, 21, 22, 23, 24 and 25 are views for explaining an operation of the sheet supplying apparatus.

In the second embodiment, when the sucker holding member 22' is lowered, as shown in FIG. 20, the rubber member 56 is firstly contacted with the uppermost film F. When the sucker holding member 22' is further lowered, the detecting lever 53 is shifted upwardly due to the reaction force from the film stack F, with the result that the slit 57 is detected by the photo-detector 58 and the lowering movement of the sucker holding member 22' is stopped.

Figure 21:
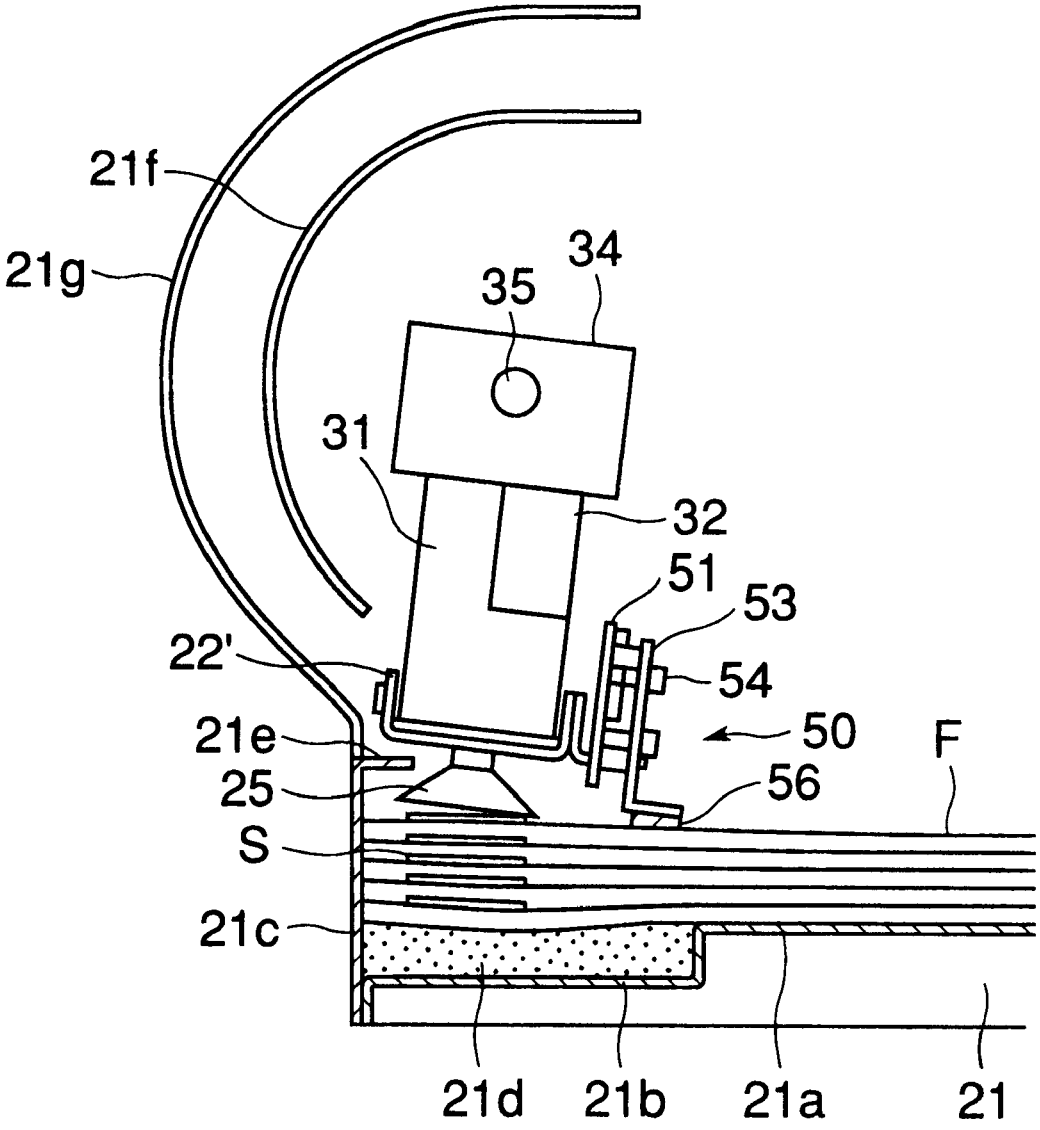
Figure 22:
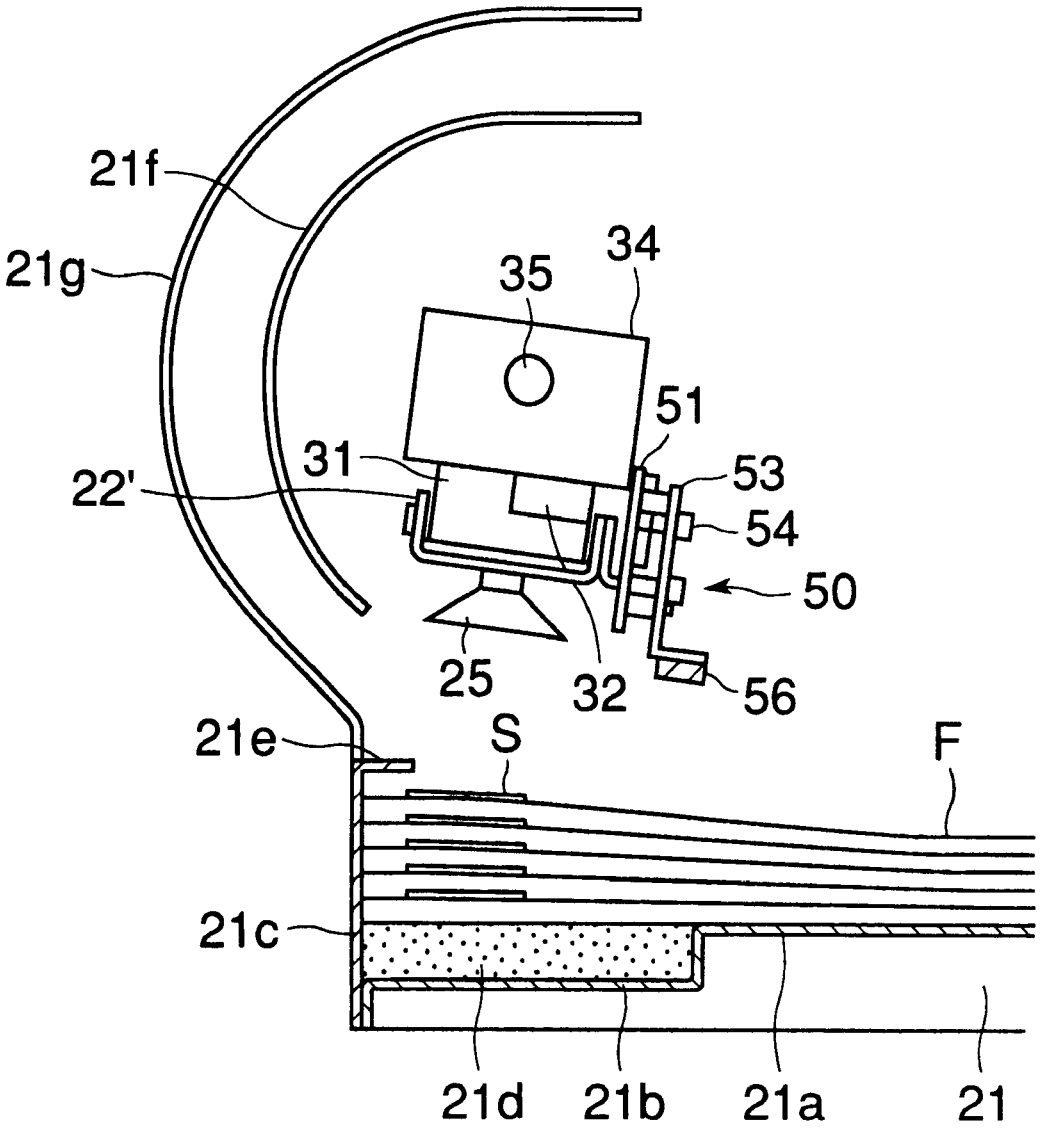
Figure 23:
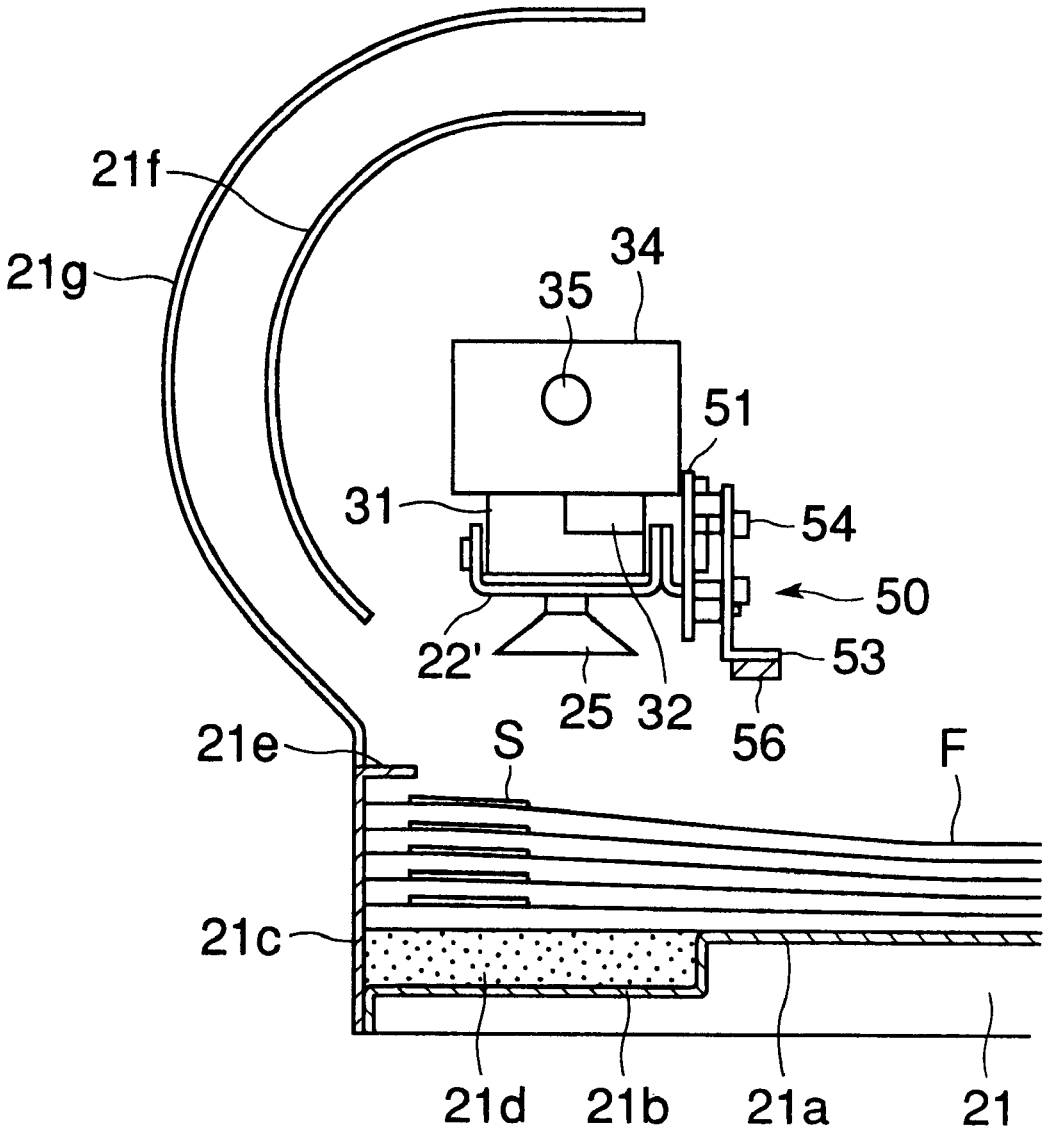
Figure 24:
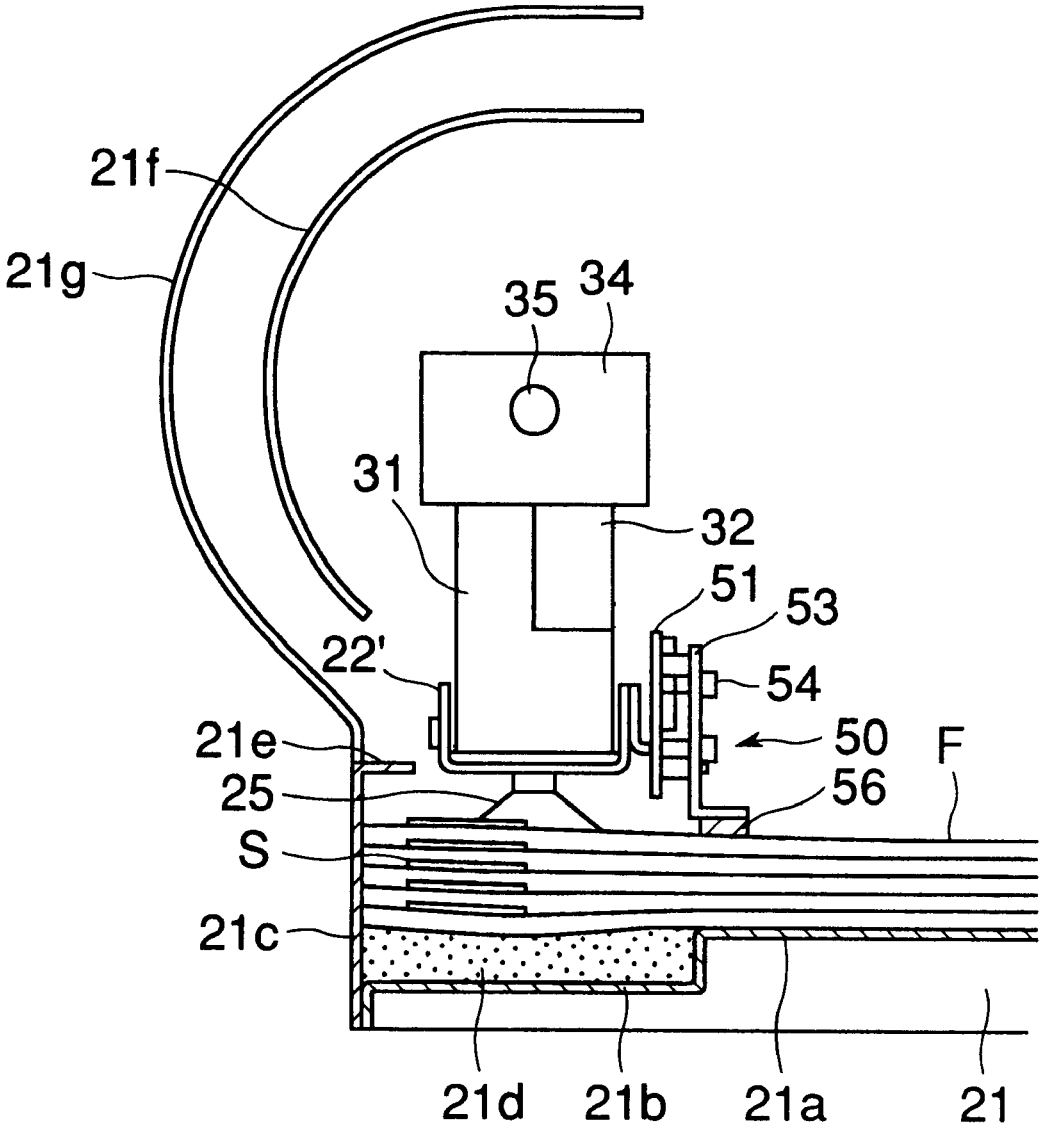
Figure 25:
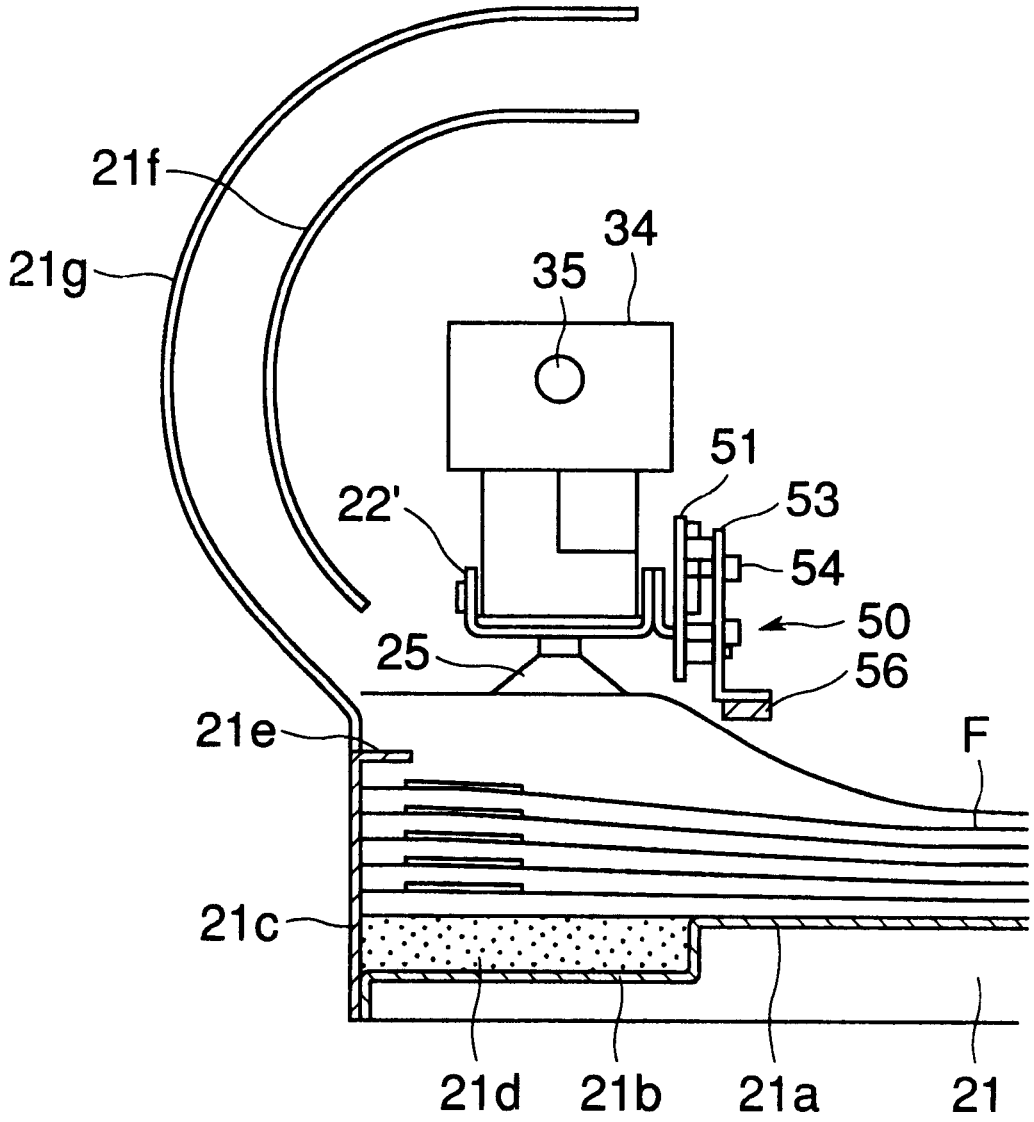

Then, as in the first embodiment, the sucker holding member 22' is rotated around the rotary shaft 35, with the result that, as shown in FIG. 21, the uppermost film F is moved by the rubber member 56 until the uppermost film abuts against the regulating plate 21*c* of the sheet holding member 21, thereby positioning the tip end of the film F in parallel with the main scanning direction. Then, the sucker holding member 22' is lifted as shown in FIG. 22 and is returned to the initial position as shown in FIG. 23. Thereafter, the same operation as the first embodiment are effected. That is to say, as shown in FIG. 24, the sucker holding member 22' is lowered, and, after the uppermost film F is absorbed by the suckers 25, 26 by the action of the vacuum pump, the sucker holding member 22' is lifted as shown in FIG. 25.

In the second embodiment, the same effect as the first embodiment can be expected and, unlike the first embodiment, it is not required that the absorption detection signal is generated by the pressure sensor of the first embodiment and the vacuum pump is temporarily stopped.

Figure 26:
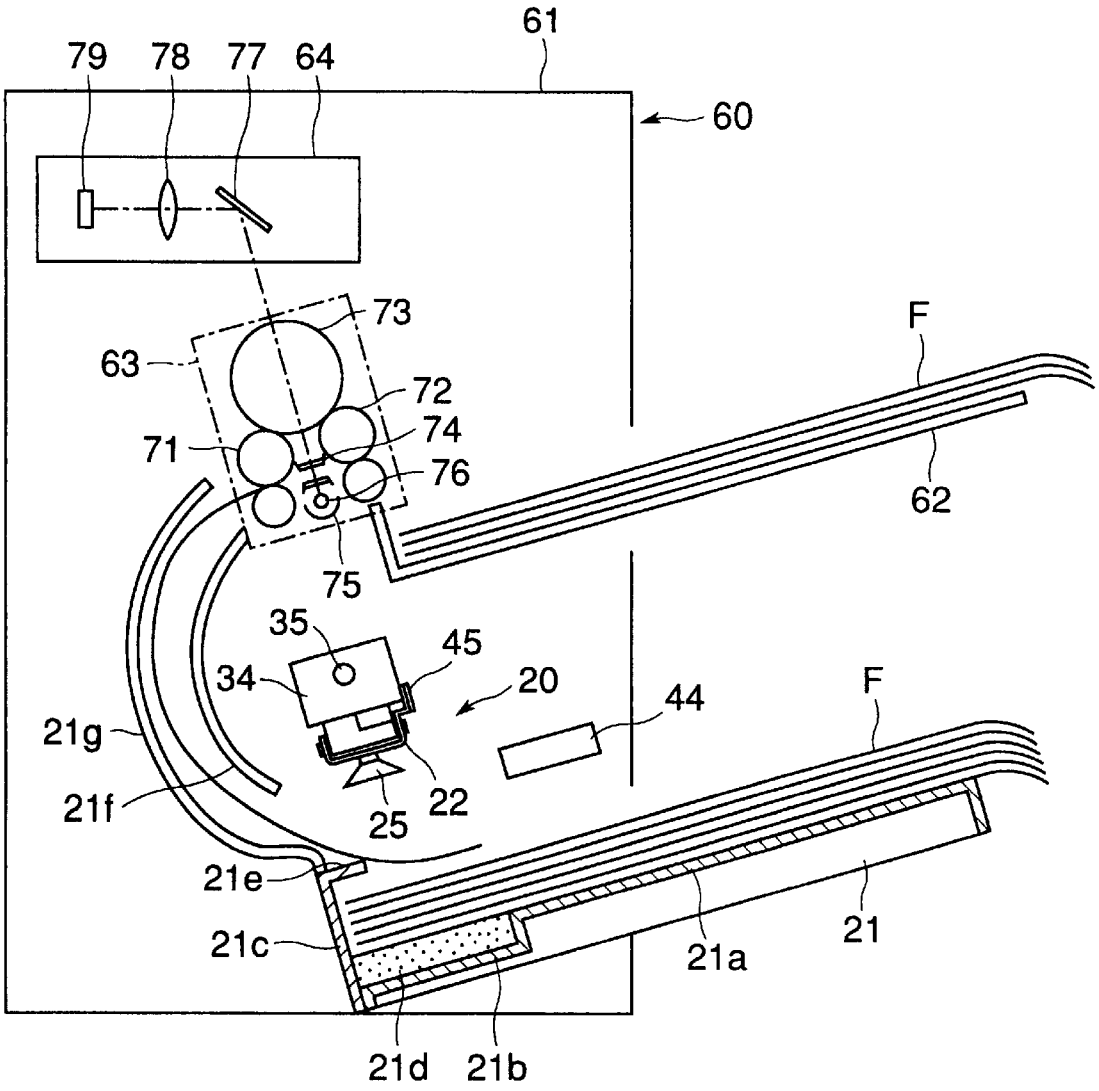
FIG. 26 is a constructural view of an image reading apparatus according to a third embodiment of the present invention.
Figure 27:
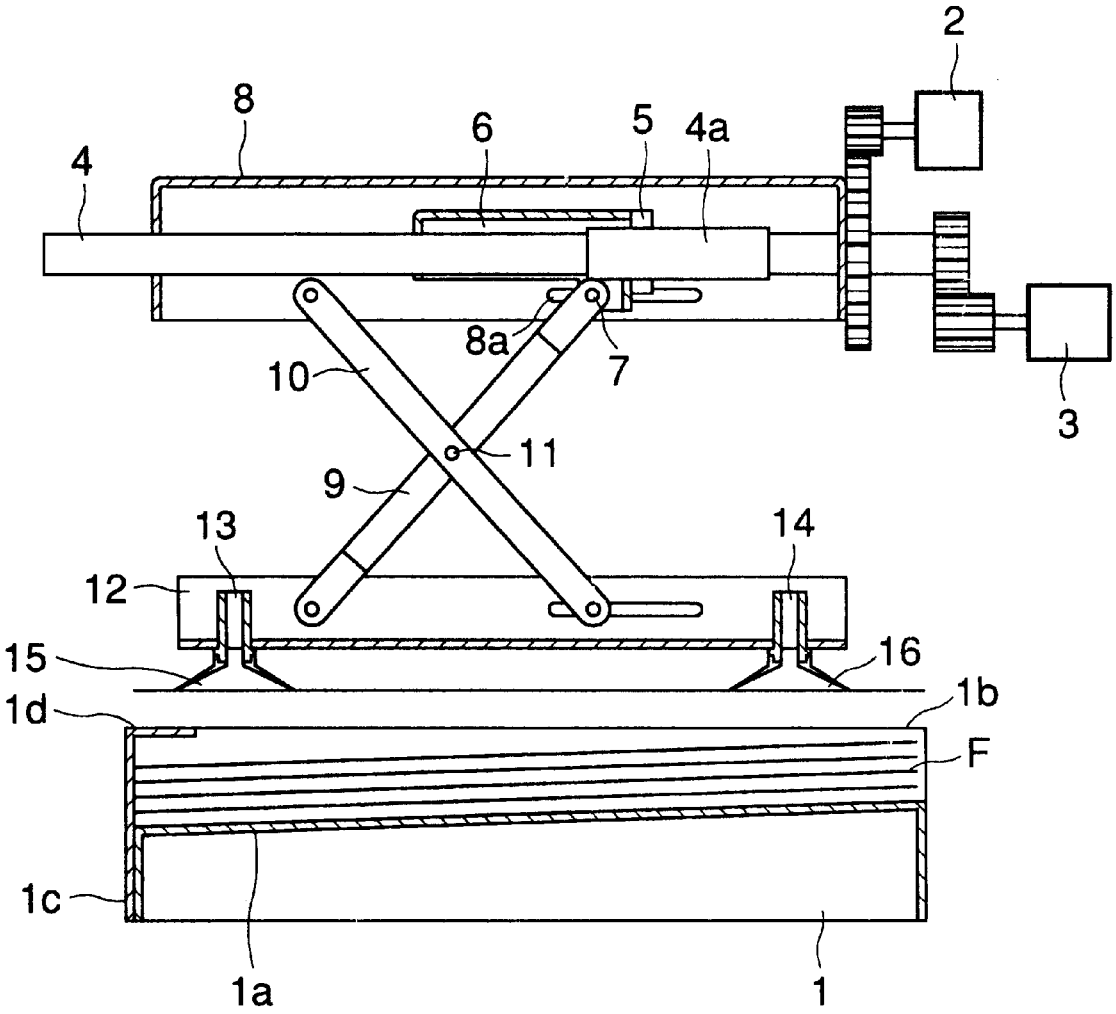
FIG. 27 is an elevational sectional view of a conventional sheet supplying apparatus.

FIG. 26 is a constructural view showing an image reading apparatus 60 according to a third embodiment of the present invention. The sheet supplying apparatus 20 according to the first embodiment is disposed at a lower part of a body 61 of the image reading apparatus, and a sheet receiving member 62 for receiving the film F is disposed above the sheet supplying apparatus 20. A sub-scanning mechanism 63 is disposed between the guides 21*f*, 21*g* and the sheet receiving member 62, and an optical unit 64 is disposed above the sub-scanning mechanism 63.

In the sub-scanning mechanism 63, there are provided a first pair of rollers 71 disposed near the guides 21*f*, 21*g* and a second pair of rollers 72 disposed near the sheet receiving member 62. One of each pair of rollers is connected to a corresponding drive motor (not shown). A pulley 73 disposed above the pairs of rollers 71, 72 is contacted with the rollers 71, 72 to transmit rotation and, below the pulley 73 and between the pairs of rollers 71 and 72, there are arranged, from the above, a pair of guides 74 each having a slit extending in the main scanning direction, and a lamp 76 having a reflection cover 75 directing toward the optical unit 64. The optical unit 64 includes therein a reflection mirror 77 for reflecting a light beam emitted from the lamp 76, a lens 78 for focusing the light beam from the reflection mirror 77, and a CCD 79 for receiving the light beam from the lens 78.

In the image reading apparatus 60 so constructed, as in the first embodiment, the bar code on the film F is read, the posture of the uppermost film F is corrected and the film F is supplied to the sub-scanning mechanism 63 through between the guides 21*f* and 21*g*. After the tip end of the film F is pinched between the first pair of rollers 71, the film F is released from the suckers 25, 26. The sucker holding member 22 is retarded to a position where it does not interfere with the film F and then is returned to the initial position.

The film F is supplied by the first pair of rollers 71 to the second pair of rollers 72 at a constant speed. Meanwhile, the film F is exposed by the lamp 76, and the light beam passed through the film F is reflected by the reflection mirror 77 and then is focused onto the CCD 79 through the lens 78. In this way, the image information from the film F is read by the optical unit 64. Thereafter, the film F is discharged onto the sheet receiving member 62 by the second pair of rollers 72.

In this third embodiment, since the sheet supplying apparatus 20 according to the first embodiment is used, the same effect as the first embodiment can be obtained.

Incidentally, in the third embodiment, while an example that the sheet supplying apparatus 20 according to the first embodiment is used was explained, the sheet supplying apparatus 20' according to the second embodiment may be used. Further, the sheet supplying apparatus 20 can be used with an image recording apparatus in which a recording system using a semiconductor is used in place of the image information reading system such as the CCD and the like.

As mentioned above, since there are provided the height detecting mechanism for detecting the height position of the uppermost sheet and the sheet urging means for urging the uppermost sheet with the predetermined pressure and for moving the sheet toward the regulating plate on the basis of the detection signal from the height detecting mechanism, the uppermost sheet can be urged by the sheet urging means with the predetermined pressure by controlling the position of the sucker holding member by the height detecting mechanism, the uppermost sheet can abut against the regulating plate by rotating the sucker holding member, and the sheet can be supplied with the correct posture.

What is claimed is:

1. A sheet supplying apparatus comprising:

a sheet holding member for holding a plurality of sheets and having a regulating wall for regulating movement of the sheets in a sheet supplying direction;

a sucker member having a sucker for absorbing an uppermost sheet among the sheets held by said sheet holding member;

a pressure reduction means for reducing pressure in said sucker;

drive means for driving said sucker member to convey the sheet absorbed by said sucker;

height detecting means for detecting a height position of the uppermost sheet; and sheet urging means for urging the sheets in a sheet stacking direction and for moving the sheet toward said regulating wall, said sheet urging means urging the uppermost sheet with predetermined pressure on the basis of a detected result from said height detecting means.

2. A sheet supplying apparatus according to claim 1, wherein an urging force of said sheet urging means is a force sufficient to move a tip end of the uppermost sheet in the sheet supplying direction up to said regulating wall.

3. A sheet supplying apparatus according to claim 1, further comprising means for regulating a vertical position and a rotational position of said sucker member on the basis of the detected result from said height detecting means.

4. A sheet supplying apparatus according to claim 1, wherein said sheet urging means effects the urging by using said sucker member.

5. A sheet supplying apparatus according to claim 4, wherein said height detecting means detects the height position of the uppermost sheet on the basis of change in pressure in said sucker.

6. A sheet supplying apparatus according to claim 1, wherein said sheet urging means comprising a sliding member biased downwardly and slidable upwardly.

7. A sheet supplying apparatus according to claim 6, wherein said height detecting means detects the height position of the uppermost sheet on the basis of an upward sliding movement of said sliding member.

8. An apparatus for effecting recording or reading of information on a sheet, comprising:

a sheet supplying means for supplying a sheet, said sheet supplying means including (A) a sheet holding member adapted to hold a plurality of sheets and having a regulating wall for regulating movement of the sheets in a sheet supplying direction, (B) a sucker member having a sucker for absorbing an uppermost sheet among the sheets held by said sheet holding member, (C) pressure reduction means for reducing pressure in said sucker, (D) drive means for driving said sucker member to convey the sheet absorbed by said sucker, (E) height detecting means for detecting a height position of the uppermost sheet, and (F) a sheet urging means for urging the sheets in a sheet stacking direction and for moving the sheet toward said regulating wall, said sheet urging means urging the uppermost sheet with predetermined pressure on the basis of a detected result from said height detecting means; and a recording or reading means for effecting recording or reading of information on the sheet supplied by said sheet supplying means.

9. A sheet supplying apparatus comprising:

a sheet containing portion having a regulating wall for regulating movement of sheets;

a sucker member for absorbing an uppermost sheet among the sheets in said sheet containing portion;

a shifting mechanism for shifting said sucker member to convey the sheet absorbed by said sucker member; and a sheet urging mechanism operated for urging the sheets in a sheet stacking direction and for moving the sheet toward said regulating wall, said sheet urging mechanism being constructed to urge the uppermost sheet with predetermined pressure, wherein said sheet urging mechanism is only operated before the uppermost sheet is absorbed by said sucker member.

10. A sheet supplying apparatus according to claim 9, further comprising height detecting means for detecting a height position of the uppermost sheet.

11. A sheet supplying apparatus according to claim 10, wherein said sheet urging mechanism urges the uppermost sheet with the predetermined pressure by stopping said sheet urging mechanism at a predetermined position on the basis of a height position detected by said height detecting means.

12. A sheet supplying apparatus according to claim 10, wherein said sheet urging mechanism changes the movement of the sheet on the basis of a height position detected by said height detecting means.

13. A sheet supplying apparatus according to claim 9, wherein said sheet urging mechanism effects the urging by using said sucker member.

14. A sheet supplying apparatus according to claim 9, wherein said sheet urging mechanism is disposed in parallel with said sucker member.

15. A sheet supplying apparatus according to claim 9, wherein said sheet urging mechanism moves the uppermost sheet by rotation.

16. An apparatus for effecting recording or reading of information on a sheet, comprising:

a sheet supplying unit adapted to supply a sheet, said sheet supplying unit including (A) a sheet containing portion having a regulating wall for regulating movement of sheets, (B) a sucker member for absorbing an uppermost sheet among the sheets in said sheet containing portion, (C) a shifting mechanism for shifting said sucker member to convey the sheet absorbed by said sucker member, and (D) a sheet urging mechanism for urging the sheets in the sheet stacking direction and for moving the sheet toward said regulating wall, said sheet urging mechanism being constructed to urge the uppermost sheet with predetermined pressure, wherein said sheet urging mechanism is only operated before the uppermost sheet is absorbed by said sucker member; and a recording or reading unit for effecting recording or reading of information on the sheet supplied by said sheet supplying unit.

* * * * *

UNITED STATES PATENT AND TRADEMARK OFFICE

CERTIFICATE OF CORRECTION

PATENT NO. : 6,095,514

DATED : August 1, 2000

INVENTOR(S): TOMOHIRO KUDO, ET AL.

It is certified that error appears in the above-identified patent and that said Letters Patent is hereby corrected as shown below:

[56] REFERENCES CITED:

U.S. PATENT DOCUMENTS, "4,480,026 10/1984 Kaneko" should read --4,480,826 10/1984 Kaneko--.

[57] ABSTRACT:

Line 12, "sheet member" should read --sheet urging member--; and "means urging" should be deleted.

COLUMN 7:

Line 11, "directing" should read --directed--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*